US012247339B2

(12) United States Patent
Kim et al.

(10) Patent No.: US 12,247,339 B2
(45) Date of Patent: Mar. 11, 2025

(54) METHOD FOR CONTROLLING GARMENT PROCESSING DEVICE

(71) Applicant: LG Electronics Inc., Seoul (KR)

(72) Inventors: Seungjoon Kim, Seoul (KR); Jongryong Kim, Seoul (KR); Jekwang Choi, Seoul (KR); Seungchul Park, Seoul (KR)

(73) Assignee: LG Electronics Inc., Seoul (KR)

( * ) Notice: Subject to any disclaimer, the term of this patent is extended or adjusted under 35 U.S.C. 154(b) by 173 days.

(21) Appl. No.: 17/787,138

(22) PCT Filed: Dec. 17, 2020

(86) PCT No.: PCT/KR2020/018493

§ 371 (c)(1),
(2) Date: Jun. 17, 2022

(87) PCT Pub. No.: WO2021/125812

PCT Pub. Date: Jun. 24, 2021

(65) Prior Publication Data

US 2023/0035888 A1 Feb. 2, 2023

(30) Foreign Application Priority Data

Dec. 20, 2019 (KR) ..... 10-2019-0171817

(51) Int. Cl.
*D06F 33/48* (2020.01)
*D06F 33/40* (2020.01)
(Continued)

(52) U.S. Cl.
CPC ..... *D06F 33/48* (2020.02); *D06F 33/40* (2020.02); *D06F 33/42* (2020.02);
(Continued)

(58) Field of Classification Search
CPC ..... D06F 33/40; D06F 33/42; D06F 33/48; D06F 33/60; D06F 33/76; D06F 34/16;
(Continued)

(56) References Cited

U.S. PATENT DOCUMENTS 10,066,333 B2 9/2018 Kim et al.
2003/0056302 A1 3/2003 Broker et al.
(Continued)

FOREIGN PATENT DOCUMENTS

CN 1683631 10/2005
CN 106400391 2/2017
(Continued)

OTHER PUBLICATIONS

International Search Report and Written Opinion in International Appln. No. PCT/KR2020/018493, dated Mar. 26, 2021, 15 pages (with English translation).
(Continued)

*Primary Examiner* — David G Cormier
(74) *Attorney, Agent, or Firm* — Fish & Richardson P.C.

(57) ABSTRACT

A method controls a garment processing device and includes rotating a drum inside a tub at a first rate, measuring a degree of imbalance of laundry while rotating the drum at the first rate, increasing the rate of rotation to a second rate based on a first measurement being less than or equal to a first reference value, rotating the drum at a second rate, measuring the degree of imbalance while rotating the drum at the second rate, stopping rotation of the drum based on a second measurement being less than or equal to a second reference value, accelerating the drum to a third rate higher than the second rate, thereby removing water from the garments, and stopping rotation of the drum based on the degree of imbalance of the drum becoming larger than an imbalance reference value that is set based on the second measured value.

20 Claims, 6 Drawing Sheets

(51) Int. Cl.

| | |
|---|---|
| ***D06F 33/42*** | (2020.01) |
| *D06F 103/24* | (2020.01) |
| *D06F 103/26* | (2020.01) |
| *D06F 105/08* | (2020.01) |
| *D06F 105/48* | (2020.01) |
| *D06F 105/62* | (2020.01) |

(52) U.S. Cl.
CPC ..... *D06F 2103/24* (2020.02); *D06F 2103/26* (2020.02); *D06F 2105/08* (2020.02); *D06F 2105/48* (2020.02); *D06F 2105/62* (2020.02)

(58) Field of Classification Search
CPC ..... D06F 35/007; D06F 2103/24; D06F 2103/26; D06F 2105/46; D06F 2105/48; D06F 2105/62
See application file for complete search history.

(56) References Cited

U.S. PATENT DOCUMENTS

| | | | | |
|---|---|---|---|---|
| 2005/0283919 | A1 | 12/2005 | Kim | |
| 2007/0124871 | A1 | 6/2007 | Kwon et al. | |
| 2017/0342629 | A1 | 11/2017 | Gwon et al. | |
| 2019/0003100 | A1* | 1/2019 | Asami ..... | D06F 37/245 |

FOREIGN PATENT DOCUMENTS

| | | |
|---|---|---|
| CN | 114829692 | 7/2022 |
| JP | 2005-065998 | 3/2005 |
| JP | 2008-125789 | 6/2008 |
| JP | 2012170675 | 9/2012 |
| KR | 10-1999-0031207 A | 5/1999 |
| KR | 20070031194 | 3/2007 |
| KR | 101065690 | 9/2011 |
| KR | 20120109171 | 10/2012 |
| KR | 101757303 | 7/2017 |
| WO | WO 2017209491 | 12/2017 |
| WO | WO 2018182277 | 10/2018 |

OTHER PUBLICATIONS

Office Action in Chinese Appln. No. 202080088278.2, dated Mar. 10, 2023, 13 pages (with English translation).
Extended European Search Report in European Appln. No. 20904056.7, dated Dec. 20, 2022, 9 pages.
Office Action in Vietnamese Appln. No. 1-2022-04258, mailed on May 3, 2024, 4 pages (with English translation).

* cited by examiner

METHOD FOR CONTROLLING GARMENT PROCESSING DEVICE

CROSS-REFERENCE TO RELATED APPLICATIONS

This application is a National Stage application under 35 U.S.C. § 371 of International Application No. PCT/KR2020/018493, filed on Dec. 17, 2020, which claims the benefit of Korean Patent Application No. 10-2019-0171817, filed on Dec. 20, 2019. The disclosures of the prior applications are incorporated by reference in their entirety.

TECHNICAL FIELD

The present disclosure relates to a method for controlling a laundry treating apparatus. More particularly, the present disclosure relates to a control method for sensing detecting a degree of an occurrence of unbalance that may occur during dehydration of laundry in advance and providing a dehydrating method based on the degree.

BACKGROUND ART

In general, a laundry treating apparatus as an apparatus for processing various tasks related to laundry is a concept encompassing a washing machine for washing laundry, a dryer for drying the wet laundry, a refresher for removing odors or wrinkles from the laundry, and the like.

A conventional laundry treating apparatus includes a cabinet that forms an external shape thereof, a tub that is disposed inside the cabinet to store water therein, a drum that is rotatably disposed inside the tub to store the laundry therein, and a driver that rotates the drum.

The drum may rotate without maintaining dynamic balance (dynamic equilibrium) depending on a position of the laundry stored therein. The dynamic balance means 'a state in which a centrifugal force or a moment created by the centrifugal force becomes zero with respect to a rotation shaft when a rotating body rotates'. In a case of a rigid body, when a mass distribution around the rotation shaft is constant, the dynamic balance is maintained.

Therefore, the dynamic balance in the laundry treating apparatus may be understood as a case in which a mass distribution of the laundry around a rotation shaft of the drum is within an allowable range when the drum rotates while the laundry is stored therein (a case in which the drum rotates while vibrating within an allowable range).

On the other hand, in the laundry treating apparatus, a state in which the dynamic balance is broken (unbalance) as a state in which the mass distribution is not constant around the rotation shaft of the drum when the drum rotates, which occurs when the laundry is not evenly distributed inside the drum.

In the case of the laundry treating apparatus, the vibration of the drum occurs due to the unbalance state, which is the state in which the dynamic balance is broken, and the vibration is transmitted to the tub or the cabinet to cause noise. In particular, in a case of a dehydration operation in which the laundry rotates at a high speed to remove water therefrom, when the unbalance occurs, the unbalance may not only cause the vibration and the noise, but also reduce a washing efficiency of the laundry treating apparatus. In severe cases, the laundry treating apparatus may be broken.

Korean Patent Application Publication No. 2003-0044245 relates to a control method for minimizing the unbalance during the dehydration. A magnitude of the unbalance is measured while the drum rotates at a specific RPM in a dehydration entry operation. When the magnitude of the measured unbalance exceeds a reference value, the dehydration entry operation is slowed down and stopped, and an operation of dispersing the laundry is performed again.

However, such method uses a fixed unbalance value, so that it is impossible to predict the magnitude of the unbalance in advance and apply a suitable dehydration algorithm accordingly. Therefore, there was a limit in effectively reducing a dehydration entry time and reducing the vibration and the noise.

DISCLOSURE

Technical Problem

The present disclosure is to provide a method for controlling a laundry treating apparatus for distinguishing a degree of an occurrence of unbalance during dehydration.

The present disclosure is to provide a method for controlling a laundry treating apparatus capable of setting an unbalance reference value differently depending on a cloth quality during dehydration.

The present disclosure is to provide a method for controlling a laundry treating apparatus that senses a degree of an occurrence of unbalance during dehydration in advance to provide an effective dehydration scheme based thereon.

The present disclosure is to provide a method for controlling a laundry treating apparatus that reduces a dehydration entry time of a washing machine and reduces vibration and noise by sensing a degree of an occurrence of unbalance during dehydration in advance.

Technical Solutions

In order to solve the above-mentioned problem, the present disclosure provides a control method that predicts unbalance that may occur during dehydration of laundry. That is, provided is a control method that may be used to predict unbalance that may occur during final dehydration by sensing a degree of an occurrence of unbalance during rotation at a speed lower than a rotation speed of a drum during dehydration.

To this end, one embodiment of the present disclosure provides a method for controlling a laundry treating apparatus including a foreign substance separation operation of rotating a drum rotatably disposed inside a tub with water stored therein to rub laundry inside the drum with water, a draining operation of draining water inside the tub to the outside of the tub, a first maintaining operation of maintaining a first speed after a rotation speed of the drum reaches the preset first speed, a first measurement operation of measuring a magnitude of unbalance occurring in the drum while the drum rotates at the first speed, a second maintaining operation of maintaining a second speed after accelerating the rotation speed of the drum to the preset second speed when a first measured value measured in the first measurement operation is equal to or less than a preset first reference value, a second measurement operation of measuring a magnitude of unbalance occurring in the drum while the drum rotates at the second speed, a stop operation of stopping the rotation of the drum when a second measured value measured in the second measurement operation is equal to or less than a preset second reference value, and a dehydration operation of removing water from the laundry by accelerating the drum to a third speed set higher than the second speed, wherein the dehydration operation is stopped when a magnitude of unbalance of the drum measured while accelerating the drum to the third speed is greater than a preset unbalance reference value, wherein the unbalance reference value is set based on the second measured value.

The first measurement operation may be initiated after maintaining the first maintaining operation for a preset first time.

The second maintaining operation may be initiated when a duration of the first measurement operation is equal to or greater than a preset second time when the first measured value is greater than the first reference value.

The second measurement operation may be initiated after maintaining the second maintaining operation for a preset third time.

The stop operation of stopping the rotation of the drum may be initiated when a duration of the second measurement operation is equal to or greater than a preset fourth time when the second measured value is greater than the second reference value.

The unbalance reference value may be set based on the first number of times, and the first number of times may be the number of times the second measured value is equal to or smaller than the second reference value when the first maintaining operation, the first measurement operation, the second maintaining operation, the second measurement operation, and the stop operation of stopping the rotation of the drum are repeated the preset number of repetitions.

When the first maintaining operation, the first measurement operation, the second maintaining operation, the second measurement operation, and the stop operation of stopping the rotation of the drum are repeated the preset number of repetitions, a preset waiting time may exist between two sets of repetition.

The above-mentioned solution is for a case in which there is one dehydration process in an operation process of the laundry treating apparatus. In general, there may be two dehydration processes in the operation process of the laundry treating apparatus.

For the case in which there are two dehydration processes, one embodiment of the present disclosure provides a method for controlling a laundry treating apparatus including a first foreign substance separation operation of rotating a drum rotatably disposed inside a tub with water stored therein to rub laundry inside the drum with water, a first draining operation of draining water inside the tub to the outside of the tub, a first maintaining operation of maintaining a first speed after a rotation speed of the drum reaches the preset first speed, a first measurement operation of measuring a magnitude of unbalance occurring in the drum while the drum rotates at the first speed, a second maintaining operation of maintaining a second speed after accelerating the rotation speed of the drum to the preset second speed when a first measured value measured in the first measurement operation is equal to or less than a preset first reference value, a second measurement operation of measuring a magnitude of unbalance occurring in the drum while the drum rotates at the second speed, a first stop operation of stopping the rotation of the drum when a second measured value measured in the second measurement operation is equal to or less than a preset second reference value, a first dehydration operation of removing water from the laundry by accelerating the drum to a third speed set higher than the second speed, a water supply operation of supplying water to the tub, a second foreign substance separation operation of rotating the drum rotatably disposed inside the tub to rub the laundry inside the drum with water, a second draining operation of draining water inside the tub to the outside of the tub, a third maintaining operation of maintaining a fourth speed after the rotation speed of the drum reaches the preset fourth speed, a third measurement operation of measuring a magnitude of unbalance occurring in the drum while the drum rotates at the fourth speed, a fourth maintaining operation of maintaining a fifth speed after accelerating the rotation speed of the drum to the preset fifth speed when a third measured value measured in the third measurement operation is equal to or less than a preset third reference value, a fourth measurement operation of measuring a magnitude of unbalance occurring in the drum while the drum rotates at the fifth speed, a second stop operation of stopping the rotation of the drum when a fourth measured value measured in the fourth measurement operation is equal to or less than a preset fourth reference value, and a second dehydration operation of removing water from the laundry by accelerating the drum to a sixth speed set higher than the third speed, wherein the second dehydration operation is stopped when a magnitude of unbalance of the drum measured while accelerating the drum to the sixth speed is greater than a preset unbalance reference value, wherein the unbalance reference value is set based on the second measured value and the fourth measured value.

The first measurement operation may be initiated after maintaining the first maintaining operation for a preset first time.

The second maintaining operation may be initiated when a duration of the first measurement operation is equal to or greater than a preset second time when the first measured value is greater than the first reference value.

The second measurement operation may be initiated after maintaining the second maintaining operation for a preset third time.

The first stop operation may be initiated when a duration of the second measurement operation is equal to or greater than a preset fourth time when the second measured value is greater than the second reference value.

The third measurement operation may be initiated after maintaining the third maintaining operation for a preset fifth time.

The fourth maintaining operation may be initiated when a duration of the third measurement operation is equal to or greater than a preset sixth time when the third measured value is greater than the third reference value.

The fourth measurement operation may be initiated after maintaining the third maintaining operation for a preset seventh time.

The second stop operation may be initiated when a duration of the fourth measurement operation is equal to or greater than a preset eighth time when the fourth measured value is greater than the fourth reference value.

The unbalance reference value may be set based on a sum of the first number of times and the second number of times, the first number of times may be the number of times the second measured value is equal to or smaller than the second reference value when the first maintaining operation, the first measurement operation, the second maintaining operation, the second measurement operation, and the first stop operation are repeated the preset first number of repetitions, and the second number of times may be the number of times the fourth measured value is equal to or smaller than the fourth reference value when the third maintaining operation, the third measurement operation, the fourth maintaining operation, the fourth measurement operation, and the second stop operation are repeated the preset second number of repetitions.

When the first maintaining operation, the first measurement operation, the second maintaining operation, the second measurement operation, and the first stop operation are repeated the first number of repetitions, a preset first waiting time may exist between two sets of repetition, and, when the third maintaining operation, the third measurement operation, the fourth maintaining operation, the fourth measurement operation, and the second stop operation are repeated the second number of repetitions, a preset second waiting time may exist between two sets of repetition.

The first number of repetitions and the second number of repetitions may be the same.

The first waiting time and the second waiting time may be the same.

The first speed and the fourth speed may be the same, and the second speed and the fifth speed may be the same.

Advantageous Effects

The present disclosure may provide the method for controlling the laundry treating apparatus for distinguishing the degree of the occurrence of the unbalance during the dehydration.

The present disclosure may provide the method for controlling the laundry treating apparatus capable of setting the unbalance reference value differently depending on the cloth quality during the dehydration.

The present disclosure may provide the method for controlling the laundry treating apparatus that senses the degree of the occurrence of the unbalance during the dehydration in advance to provide the effective dehydration scheme based thereon.

The present disclosure may provide the method for controlling the laundry treating apparatus that reduces the dehydration entry time of the washing machine and reduces the vibration and the noise by sensing the degree of the occurrence of the unbalance during the dehydration in advance.

The present disclosure may improve user reliability and convenience via the effective dehydration.

BEST MODE

Figure 1:
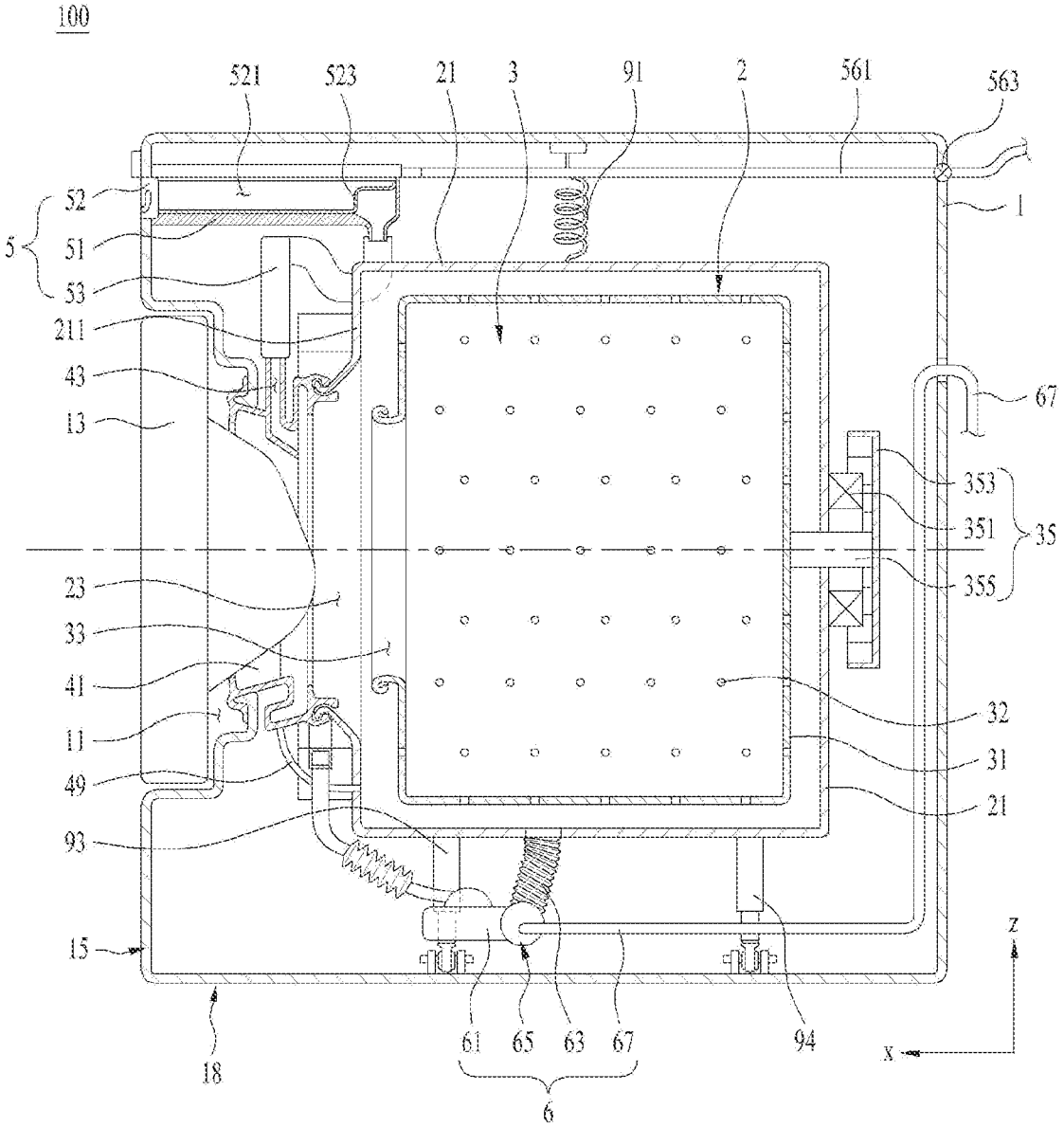
FIG. 1 illustrates an example of a laundry treating apparatus.

Hereinafter, a preferred embodiment of the present disclosure will be described in detail with reference to the accompanying drawings. A configuration or a control method of an apparatus to be described below is only for describing the embodiment of the present disclosure, not for limiting the scope of the present disclosure. Reference numerals used the same throughout the specification refer to like elements.

Specific terms used herein are only for convenience of description and are not used as a limitation of the illustrated embodiment. For example, expressions such as "same" and "identical" not only indicate the strictly identical state, but also indicate a state in which a tolerance or a difference in a degree to which the same function is obtained exists.

In general, a laundry treating apparatus may be divided into a top loading type and a front loading type depending on a method for inputting laundry (or cloth). In the top loading type, an inlet for putting the laundry is located on a top face of a cabinet, whereas in the front loading type, the inlet is located at a front face of the cabinet. In addition, the top loading type is a scheme of washing the laundry by friction between the laundry and water occurred as the water rotates by rotating blades below a drum or by the drum. On the other hand, the front loading type is a scheme of washing the laundry using a drop method to cause friction with the water when the laundry falls from the top to the bottom by the rotation of the drum.

Unlike the top loading type, in the front loading type, a difference in unbalance value based on eccentricity of the laundry is large when the drum rotates, so that it may be easier to identify a magnitude of the unbalance of the drum at a constant speed before dehydration compared to the top-loading type. For example, when a rotation speed of the drum is 42 RPM (revolutions per minute), the laundry may be lifted and dropped by the rotation of the drum. When the rotation speed of the drum is 52 RPM, the laundry may rotate together along an inner wall (an inner surface) of the drum.

In the case of the front loading type in which the unbalance may be easily measured with such change in a movement of the laundry, unbalance in a dehydration process of removing the water from the laundry via high-speed rotation may be predicted in advance to determine whether the magnitude of the unbalance will be great based on the prediction. In addition, when the unbalance is predicted in advance during the dehydration, an appropriate dehydration method may be applied accordingly. As a result, a dehydration entry time may be shortened, and low-vibration dehydration may be achieved.

Specifically, as shown in FIG. 1, a laundry treating apparatus 100 to which one embodiment of the present disclosure is applied includes a cabinet 1, a tub 2 disposed inside the cabinet to store water therein, and a drum 3 rotatably disposed inside the tub 2 to store the laundry therein.

The cabinet 1 may include a base 18 that forms a bottom face of the laundry treating apparatus (a bottom face of the cabinet), a front panel that forms a front face of the laundry treating apparatus, a rear panel that forms a rear face of the laundry treating apparatus, a top panel that forms a top face of the laundry treating apparatus, and a first side panel (not shown) and a second side panel (not shown) that are fixed to the base 18 to respectively form a left side face and a right side face of the laundry treating apparatus.

The front panel has an inlet 11 through which the laundry may be put into the drum 3 or the laundry inside the drum may be withdrawn to the outside of the cabinet. The inlet 11 is opened and closed by a door 13. The door 13 may be pivotably coupled to the front panel.

The tub 2 includes a cylindrical tub body 21 with a hollow defined therein, a front cover 211 fixed to the tub body to form a front face of the tub 2, and a rear cover 213 fixed to the tub body to form a rear face of the tub.

The front cover 211 is disposed on a side facing the front panel having the inlet 11, and the rear cover 213 is disposed on a side facing the rear panel. The front cover 211 has a tub inlet 23 in communication with the inlet 11.

The inlet 11 and the tub inlet 23 are connected to each other via an insulating portion. The insulating portion is means for not only preventing the water stored in the tub body 21 from being discharged to the cabinet 1 via the tub inlet 23, but also attenuating vibration of the tub body 21 from being transmitted to the cabinet 1.

The insulating portion includes an insulating body 41 made of an elastic body (such as rubber) and connecting the inlet 11 and the tub inlet 23 to each other. The insulating body 41 includes a first fixed body having a cylindrical shape with one end fixed to the inlet 11, a second fixed body having a cylindrical shape with the other end fixed to the tub inlet 23, and a connecting body that connects a free end of the first fixed body and a free end of the second fixed body to each other.

In order to prevent the water from remaining inside the insulating body 41, the insulating portion may further include a residual water discharge pipe 49 that connects the insulating body 41 with the front cover 211 of the tub body. It is preferable that the residual water discharge pipe 49 connects the front cover 211 with a space located below a horizontal line H passing through a center of rotation of the drum 3 of spaces provided by the insulating body 41. This is to move the water inside the insulating body 41 to the tub body 21 without a separate apparatus.

The drum 3 includes a drum body 31 rotatable inside the tub body 21. The drum body 31 is formed in a cylindrical shape with a hollow defined therein. Drum through-holes 32 for communicating an interior of the drum body with an interior of the tub body is defined in a circumferential face, a front face, and a rear face of the drum body 31. In addition, a drum inlet 33 is defined in a face (a front face of the drum) facing the inlet 11 of spaces provided by the drum body 31.

The drum body 31 is rotated by a drum driver 35. The drum driver 35 includes a stator 351 fixed to a rear face of the tub body 21 to generate a rotating field, a rotor 353 located outside of the tub body 21 to rotate by the rotating field, and a rotation shaft 355 disposed to extend through the rear face of the tub body 21 and connecting the rotor 353 and the drum body 31 to each other.

The water stored in the tub body 21 is discharged to the outside of the cabinet 1 via a drain 6. The drain 6 may include a chamber 61 that provides a space in which the water is stored, a first drain tube 63 that guides the water of the tub body 21 to the chamber 61, and a drain pump 65 that moves the water introduced into the chamber 61 to a second drain tube 67. The second drain tube 67 is means for guiding the water discharged from the drain pump 65 to the outside of the cabinet 1. The highest point of the second drain tube 67 may pass through a point higher than the lowest end of the tub inlet 23.

As shown in FIG. 1, a detergent supply 5 disposed in the present disclosure may include a casing 51 disposed inside the cabinet 1 and a drawer 52 that may be retracted into and extended from the casing 51.

The drawer 52 accommodated inside the casing 51 may be extended from the cabinet 1 via a drawer outlet (not shown) defined to extend through the front panel of the cabinet 1. The drawer 52 may be formed in a polyhedral (hexahedral or the like) shape with an open top face, and may include therein a storage 521 that provides a space in which detergent is stored and a detergent outlet 523 that communicates the storage 521 with the casing 51. The detergent outlet 523 may be defined as a through-hole extending through a rear face or a bottom face of the storage 521 or may be formed as a bell trap disposed on the bottom face of the storage 521.

The casing 51 has a water supply for supplying the water to the storage 521. FIG. 1 illustrates a case in which the water supply supplies the water to the top face of the casing 51 as an example.

The water supply includes a water supply tube 561 that supplies the water from a water supply source to the storage 521, and a water supply valve 563 that opens or closes the water supply tube 561 in response to a control signal from a controller (not shown). Therefore, when the water is supplied to the storage 521 in which the detergent is stored via the water supply tube 561, the detergent inside the storage 521 moves to the casing 51 via the detergent outlet 523 together with the water.

The water and the detergent discharged to the casing 51 may be supplied into the tub body 21 via the insulating body 41. To this end, the insulating portion 4 may have an inflow tube 43 through which the water and the detergent are introduced, and the detergent supply 5 may have a discharge tube 53 for guiding the detergent and the water to the inflow tube 42. The inlet tube 42 and the discharge tube 53 may be made of the elastic body (the rubber or the like). This is to minimize transmission of the vibration of the tub to the casing 51 and a front panel 15 via the inlet pipe 42 and the outlet pipe 53.

The tub 2 having the above structure is fixed inside the cabinet 1 via a tub support. The tub support may be composed of elastic force providing portions 91 and 92 and dampers 93, 94, and 95.

A control panel (not shown) may be disposed at an upper portion of the front panel 15. The controller may receive an operation desired by a user via the control panel and control the drum driver 35, the water supply valve 563, and the drain pump 65. The controller may perform a washing process of supplying the water and washing the laundry, a rinsing process of rinsing the laundry, a process of draining the water and dehydrating, or the like. In addition, the controller may control the rotation of the drum driver 35 to rotate the drum at a desired speed or stop the rotation of the drum.

Figure 2:
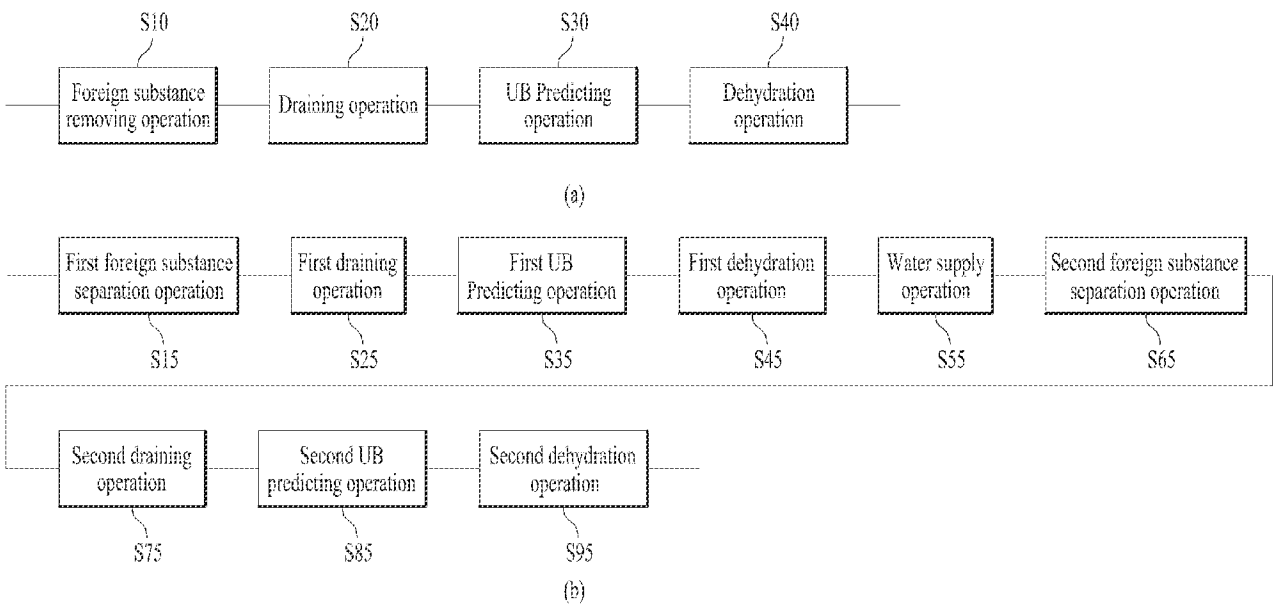
FIG. 2 illustrates an example of operation processes of a laundry treating apparatus. (a) in FIG. 2 illustrates some of operation processes of a laundry treating apparatus of when a user manually selects a rinsing process. (b) in FIG. 2 illustrates some operation processes of a laundry treating apparatus of when a user automatically selects a washing process.

FIG. 2 schematically shows operations in which the method for controlling the laundry treating apparatus, which is an embodiment of the present disclosure, is applied. The present disclosure relates to a control method for predicting the unbalance that may occur during the dehydration in advance before the dehydration. Therefore, it is possible to apply an appropriate dehydration scheme suitable for the laundry during the dehydration.

(a) in FIG. 2 shows the control method for predicting the unbalance in advance before the dehydration as a UB predicting operation (S30). The method for controlling the laundry treating apparatus may perform a dehydration operation (S40) only once as shown in (a) in FIG. 2 based on selection of a user. In contrast, in the control method of the present disclosure, the dehydration operation may be divided into two operations as shown in (b) in FIG. 2 based on the selection of the user. That is, a first UB predicting operation (S35) may be performed before a first dehydration operation (S45) and a second UB predicting operation (S85) may be performed before a second dehydration operation (S95). In general, when the laundry treating apparatus automatically performs a washing course, as shown in (b) in FIG. 2, the controller may undergo two foreign substance removing operations (S15 and S65) and two dehydration operations (S45 and S95). On the other hand, when the user manually selects the foreign substance removing operation, the controller may perform one foreign substance removing operation (S10) and one dehydration operation (S40) as shown in (a) in FIG. 2.

When only one dehydration operation (S40) is performed as shown in (a) in FIG. 2, only one UB predicting operation (S30) is performed. First, the foreign substance removing operation (S10) for removing a foreign substance from the laundry using friction with water is performed. The foreign substance removing operation (S10) may be a washing operation or a rinsing operation. Preferably, the operation (S10) may be the rinsing operation. When the foreign substance removing operation (S10) ends, the control method of the present disclosure undergoes a draining operation (S20) of draining the water stored inside the tub 2. When the draining operation (S20) ends, an operation of sensing an amount of laundry, that is, an amount of cloths, before the initiation of the dehydration may be initiated. Thereafter, the control method of the present disclosure performs the UB predicting operation (S30). In addition, the control method of the present disclosure may predict a degree of an occurrence of unbalance (or UB) via the UB predicting operation (S30). Accordingly, in the control method of the present disclosure, an unbalance reference value during the dehydration may be set, or the appropriate dehydration operation (S40) may be performed based on an expected magnitude of unbalance.

For example, even when the controller determines that the amounts of cloths are the same in a cloth amount sensing operation, the magnitude of unbalance may vary during the dehydration depending on cloth qualities of a thin laundry, a laundry of an average thickness, and a thick laundry. In addition, the magnitude of unbalance during the dehydration may vary depending on dispersion of the cloths even with the same cloth quality.

Herein, the cloth quality is a value based on an ability of the cloth to hold the water. The cloth qualities may be distinguished depending on whether a material of the cloth has a high or low moisture content. The cloth quality may vary depending on a type of the laundry. A towel absorbs a lot of water, so that it may be said that the towel has the higher moisture content. In a case of a winter jacket, it may contain more water than the towel.

When the moisture content is high, a weight of the cloth may increase and the cloth dispersion may not be good. This means that the eccentricity, that is, the unbalance, based on the weight of the cloth may occur more.

In a case of a cloth that is expected to cause a great amount of unbalance, the control method of the present disclosure may change the dehydration scheme by loosely setting the unbalance reference value during the dehydration such that the unbalance is accepted even when some degree of unbalance occurs. Alternatively, in the case of the cloth that is expected to cause the great amount of unbalance, the control method of the present disclosure may reduce the unbalance during the dehydration via the cloth dispersion before the dehydration to reduce the unbalance when entering the dehydration.

A dehydration entry operation may be performed before initiating the dehydration operation. When, as the unbalance occurs during the dehydration entry, the drum 3 stops rotating and the process of dispersing the cloths is performed again, a decrease in a time required in the dehydration may be greater than an increase in time resulted therefrom, which in turn has an effect of reducing noise and vibration.

The dehydration entry operation refers to an operation of, in order to perform the dehydration operation by rotating the drum at a high speed, identifying the degree of the occurrence of the unbalance by rotating the drum at a lower speed and dispersing the cloths. When the unbalance having the degree greater than the unbalance reference value occurs in the dehydration entry operation, after slowing down the rotation of the drum 3 and dispersing the cloths, the dehydration entry operation may be performed again. This may eventually take a lot of time in the dehydration entry.

When the unbalance reference value is set the same regardless of the cloth quality or the cloth distribution, the time required for the dehydration may increase when the great amount of unbalance occurs. Therefore, in order to prevent this, it is necessary to set the unbalance reference value differently. Ultimately, in order to set the unbalance reference value differently, a control method that predicts the degree of the occurrence of the unbalance like the control method of the present disclosure may be required.

In a case of cloth that is expected to cause a small amount of unbalance, it may be expected that the cloths have already been well dispersed or the cloth has the low moisture content. Therefore, the unbalance reference value during the dehydration may be set low, and the dehydration entry time for the dehydration may be reduced.

Therefore, as shown in (a) in FIG. 2, the magnitude of the unbalance measured in the UB predicting operation (S30) or the number of unbalance with the degree equal to greater than the set value may be determined to classify the laundry into a cloth with a great amount of unbalance, a cloth with an intermediate amount of unbalance, and a cloth with a small amount of unbalance. Reflecting the same, the unbalance reference value may be set in the dehydration operation.

In (b) in FIG. 2, when the laundry treating apparatus automatically performs a course selected in response to course selection of the user by the controller, the two dehydration operations (S45 and S95) may be performed. After a first foreign substance separation operation (S15) of removing foreign substances from the laundry via the friction with the water and a first draining operation (S25) of draining the water from the tub 2, the control method of the present disclosure may perform the first UB predicting operation (S35) prior to the first dehydration operation (S45). Thereafter, after the first dehydration operation (S45), a water supply operation (S55), a second foreign substance separation operation (S65), and a second draining operation (S75), a degree of an occurrence of unbalance of the laundry before the second dehydration operation (S95) may be predicted via the second UB predicting operation (S85). However, in this case, there is a difference between the first dehydration operation (S45) and the second dehydration operation (S95).

In the case of the first dehydration operation (S45), the drum 3 is rotated at the high speed such that the water soaked in the laundry flows out. When the controller drives the drum driver 35 to rotate the drum 3 at the high speed, the laundry rotates while being attached to the inner wall of the drum 3, so that the cloth is dehydrated by a centrifugal force. However, the first dehydration operation (S45) is not required to dehydrate the laundry to an extent that the laundry is dried. In addition, it is sufficient when the drum 3 rotates at a rotation speed at which the laundry rotates while being attached to the inner wall of the drum 124 such that a high concentration of laundry detergent remains in the cloth. Preferably, the rotation speed in the first dehydration operation (S45) may be set to be equal to or higher than 100 RPM and equal to or lower than 1000 RPM. Therefore, the dehydration entry operation (not shown) for dispersing the cloths may not be additionally performed before the second dehydration operation (S95).

In the case of the second dehydration operation (S95), the drum 3 is rotated at the high speed such that the water soaked in the laundry flows out. When the controller drives the drum driver 35 to rotate the drum 3 at the high speed, the laundry rotates while being attached to the inner wall of the drum 3, so that the laundry is dehydrated by the centrifugal force. In the second dehydration operation (S95), the rotation speed of the drum 3 may be set to be equal to or higher than 1000 RPM.

Therefore, the first dehydration operation (S45) may be viewed as a simple dehydration operation and the second dehydration operation (S95) may be viewed as a main dehydration operation.

Because the rotation speed of the first dehydration operation (S45) is smaller than the rotation speed of the second dehydration operation (S95), a magnitude of the unbalance in the first dehydration operation (S45) may be smaller than the unbalance reference value in the second dehydration operation. Therefore, there is no need to control the occurrence of unbalance in the first dehydration operation (S45), so that a result of the first UB predicting operation (S35) performed before the first dehydration operation (S45) may be combined with a result of the second UB predicting operation (S85) and utilized to predict the magnitude of unbalance in the second dehydration operation (S95). The magnitude of unbalance in the second dehydration operation (S95) may be more accurately predicted by performing the two UB predicting operations (S35 and S85). In addition, the control method of the present disclosure may predict the degree of the occurrence of the unbalance (or the UB) via the two UB predicting operations (S35 and S85). Accordingly, in the control method of the present disclosure, the unbalance reference value during the dehydration may be set, or the appropriate dehydration operation (S40) may be performed based on the expected magnitude of the unbalance.

Figure 3:
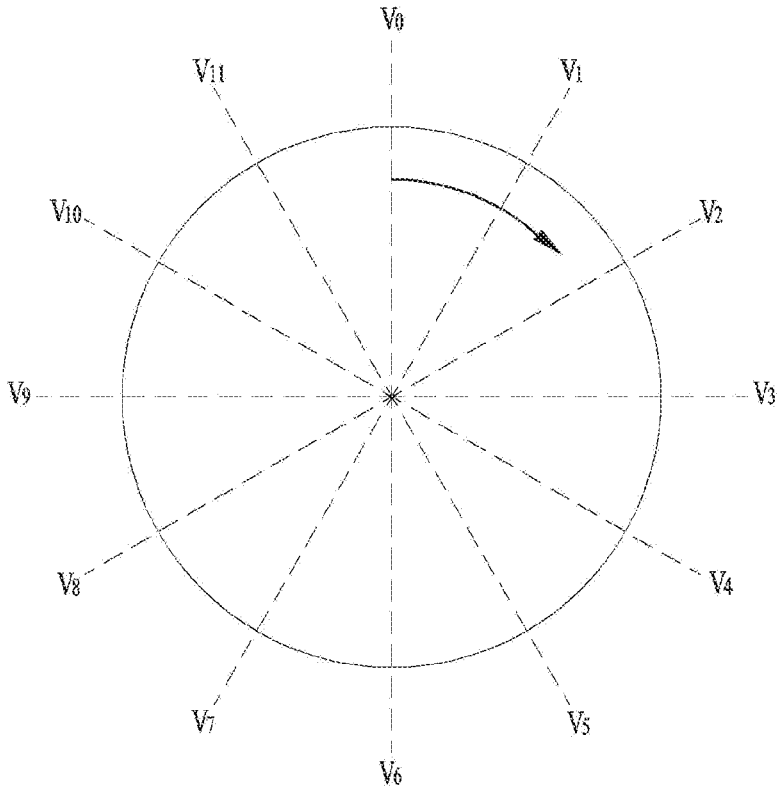
FIG. 3 illustrates an example of a method for measuring unbalance by dividing a rotation region of a drum based on a certain angle.

FIG. 3 is a diagram for illustrating one embodiment for measuring a magnitude of unbalance. The unbalance (UB) refers to a factor that determines a degree of bias (the eccentricity) of loads (the laundry) inside the drum 3 that occurs during the dehydration operation of the laundry treating apparatus 100. When the unbalance occurs, the noise and the vibration occur and a washing performance of a washing machine is deteriorated, so that the washing machine must be designed in a direction to minimize the unbalance. As schemes for determining such UB, there are a scheme using a speed UB of determining the degree of bias of the loads using a speed change that occurs when the drum 3 rotates and a scheme using a current UB of determining the degree of bias of the loads using a force (a current) applied to the drum driver 35, for example, a motor, that rotates the drum 3.

A conventionally used scheme is the scheme using the speed UB of sensing the degree of eccentricity using the speed change that occurs during the rotation of the drum 3. A rotation region of the drum 3 is divided into a plurality of rotation sections based on a rotation angle of the motor, and a rotation speed at each angle is measured. In FIG. 3, as one of such embodiments, the unbalance is measured by dividing the rotation region of the drum 3 into the rotation sections based on an angle of 30 degrees and measuring the speeds at a total of 12 points.

In a case of a laundry treating apparatus of a front loading type, when the drum 3 rotates, a force in a direction of gravity is applied due to the eccentricity, and accordingly, a difference in the speed may occur during the rotation. In addition, the change in the speed shows a difference when the eccentricity is large and small. The UB is a scheme using such phenomenon to sense the degree of eccentricity.

A speed value measured as such is calculated by Mathematical Equation 1 below. Because a twelfth speed is the same as a zeroth speed because of a cyclic arrangement of angles, a condition shown in Mathematical Equation 2 below must be satisfied.

$$\alpha_k=(v_k+v_{k-1}+\ldots+v_{k-5})-(v_{k-6}+v_{k-7}+\ldots+v_{k-11}) \quad \text{[Mathematical Equation 1]}$$

$$v_k=v_{k+12} \quad \text{[Mathematical Equation 2]}$$

That is, after sensing the rotation speed of the drum 3 every 30 degrees when the drum 3 rotates, a rotation speed $v_k$ sensed every 30 degrees may be substituted into Mathematical Equation 1 and subjected to a series of signal processing operations to obtain the UB value by Mathematical Equation 3 below.

$$UB(k)=\max(a_k,a_{k-1},\ldots,a_{k-11})-\min(a_k,a_{k-1},\ldots,a_{k-11}) \quad \text{[Mathematical Equation 3]}$$

That is, $a_1$ is obtained through an initial one rotation, and then v is replaced with a new value obtained each time the motor rotates another 30 degrees, for example, $v_3$, to obtain $a_2$. After calculating $a_1$ to $a_{12}$ in such manner, the UB is obtained by subtracting a minimum value from a maximum value as in Mathematical Equation 3. Accordingly, the UB value is generated every 30 degrees after said one rotation, and accordingly, a UB(k) value is continuously generated. The UB(k) value obtained as such is updated with a new value every 30-degree rotation, and an average value thereof is calculated as an unbalanced value of moving average (hereinafter, UBVMA).

When the unbalance is large, the UBVMA value will be high, and when the unbalance is small, the UBVMA value will also be low. Therefore, the UBVMA value may be one reference value in determining the degree of the occurrence of the unbalance based on the rotation of the drum 3. One embodiment of the present disclosure may use the UBVMA value as a first reference value, a second reference value, a third reference value, or a fourth reference value based on the rotation speed.

Figure 4:
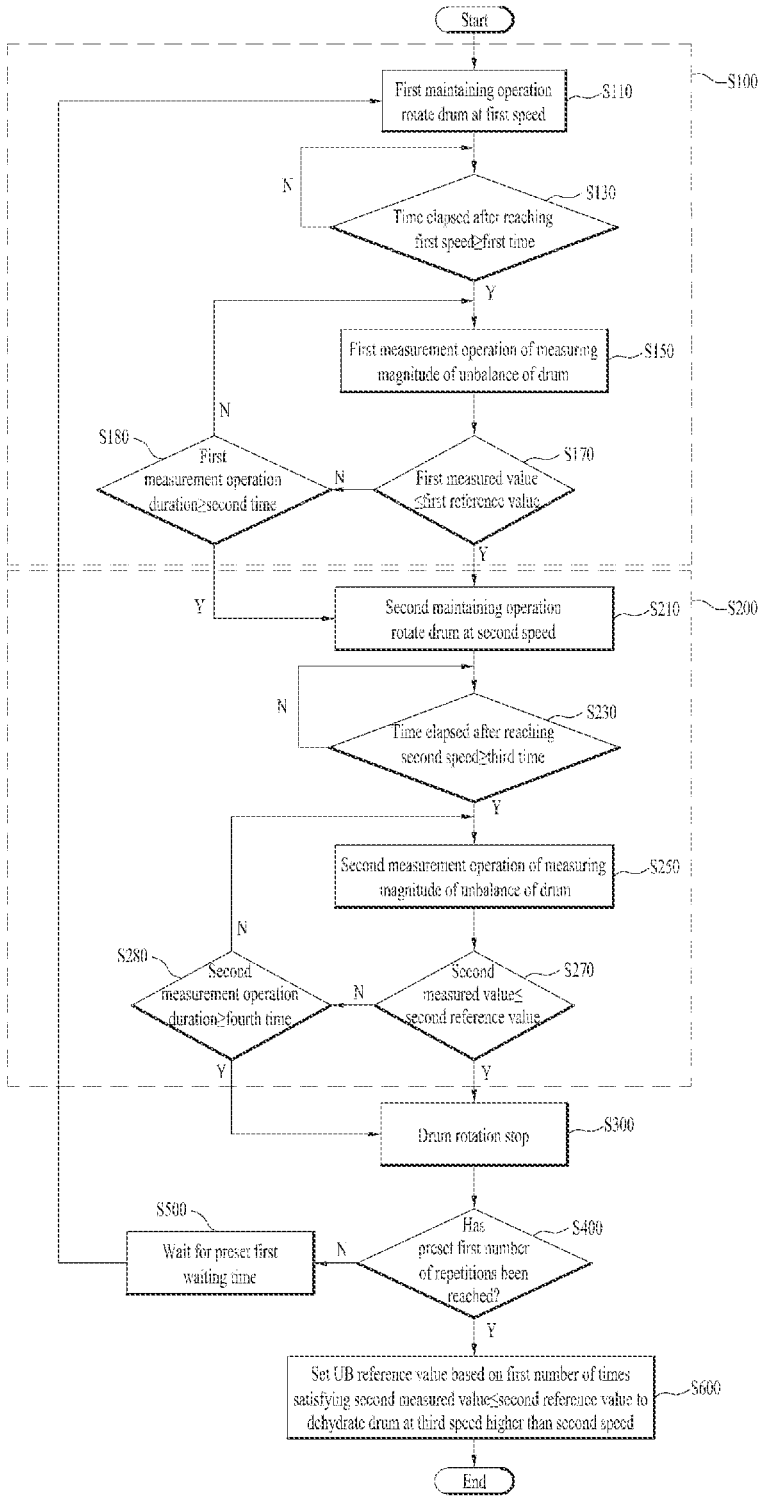
FIG. 4 is a flowchart illustrating an example of a method for controlling a laundry treating apparatus according to the present disclosure of when a user manually selects a rinsing process.

FIG. 4 is a flowchart showing an example in a case in which a user manually selects a rinsing process. As described above, in case of the manual selection of the user, each of the rinsing process and the dehydration process may be performed once.

An example of the control method of the present disclosure is largely composed of an operation (S100) of measuring a first measured value that is the UB value of the drum 3 while maintaining the drum 3 at a preset first speed and comparing the first measured value with the preset first reference value, an operation (S200) of measuring a second measured value that is the UB value of the drum 3 while maintaining the drum 3 at a preset second speed and comparing the second measured value with the preset second reference value, an operation (S300) of stopping the rotation of the drum 3, and an operation (S600) of setting a UB reference value in the dehydration operation to be performed later based on the second measured value and dehydrating the drum 3 at a preset third speed higher than the second speed.

The first speed may be a speed at which the drum 3 is rotated in order to disperse the laundry inside the drum 3 before rotating the drum 3 at the second speed. Preferably the first speed may be set to 42 RPM. The second speed may be a rotation speed of the drum 3 used to measure the occurrence of the unbalance when the drum 3 rotates. Preferably the second speed may be 58 RPM. The third speed is a rotation speed used in a final dehydration operation when the user manually selects the rinsing process.

The first measured value is a value obtained by measuring a magnitude of unbalance that occurs when the drum 3 rotates at the first speed, and the first reference value is a preset value that the first measured value must satisfy. The second measured value is a value obtained by measuring a magnitude of unbalance that occurs when the drum 3 rotates at the second speed, and the second reference value is a preset value that the second measured value must satisfy.

When describing the above in detail again, first, after the foreign substance separation operation of rotating the drum 3 that is rotatably disposed inside the tub 2 in which the water is stored to cause the friction between the laundry inside the drum 3 and the water and the draining operation of draining the water inside the tub 2 to the outside of the tub 2, the control method of the present disclosure may perform a first maintaining operation (S110) of maintaining the first speed after the rotation speed of the drum 3 reaches the preset first speed.

The first maintaining operation (S110) is an operation required to stably rotate the drum 3 at the first speed. This is because, when the drum 3 is accelerated from a stop state to the first speed, the rotation speed does not reach the first speed immediately, but reaches the first speed after going through fluctuation to some extent. Accordingly, a first time may be required for the drum 3 to stably rotate at the first speed.

The first time may mean a time required to stabilize the drum 3 at the first speed, and may preferably be set in a range from 1 second to 3 seconds. This is because, when the first time is set to be shorter than 1 second, a time is insufficient for the stabilization, and when the first time is set to be longer than 3 seconds, the dehydration time may become unintentionally long. In addition, the first speed as a rotation speed set to be lower than the third speed, which is the rotation speed during the dehydration operation (S600), may be preferably 42 RPM.

Therefore, the control method of the present disclosure may proceed with the first maintaining operation (S110) of maintaining the drum 3 at the first speed until the first time elapses (S130) after reaching the first speed.

After the first time elapses, the control method of the present disclosure may proceed to a first measurement operation (S150) of measuring the magnitude of the unbalance of the drum 3 (the first measured value). When the first measured value is equal to or smaller than the first reference value (S170), the control method of the present disclosure may proceed to a second maintaining operation (S210) of maintaining the second speed after accelerating the rotation speed of the drum 3 to the preset second speed.

However, when the first measured value exceeds the first reference value (S170), the control method of the present disclosure may repeatedly perform the first measurement operation (S150) and the operation (S170) of determining whether the first measured value is equal to or smaller than the first reference value when a time elapsed after the first time has elapsed is less than a preset second time (S180).

Even when the first measured value exceeds the first reference value (S170), when the time elapsed after the first time has elapsed reaches the preset second time (S180), the control method of the present disclosure may no longer repeat the first measurement operation (S150) and the operation of determining whether the first measured value is equal to or less than the first reference value (S170), and may proceed to a second maintaining operation (S210) of maintaining the second speed after accelerating the rotation speed of the drum 3 to the preset second speed.

Preferably, as described above, the first measured value may be a first unbalanced value of moving average (UBVMA) calculated using the speed UB, and the first reference value may also be a preset first reference unbalanced value of moving average (UBVMA). The first reference unbalanced value of moving average (UBVMA) may be preferably 200 A.U. A.U is an arbitrary unit that may vary depending on a method for processing the measured value, but the unbalanced value of moving average may preferably be a value obtained by converting the speed value into the current value. Therefore, a unit of the unbalanced value of moving average may be A (ampere) or mA (milliampere), which is a unit of the current value.

The reason why the control method of the present disclosure stabilizes the drum 3 at the first speed for the first time without immediately accelerating the drum 3 from the stop state to the second speed and then proceeds to the second maintaining operation (S210) immediately when the first measured value, which is the measured UB value, is equal to or smaller than the first reference value within the second time after the first time has elapsed is that the unbalance does not occur much at the first speed because the first measured value is equal to or smaller than the first reference value. Therefore, in order to measure the second measured value, which is a measured value actually used to predict the occurrence of unbalance, the controller directly accelerates the drum 3 to the second speed.

However, when the first measured value is greater than the first reference value, it means that the great amount of unbalance occurs at the first speed. Therefore, the first measured value is continuously measured again (S150) and is compared with the first reference value again (S170) without the drum 3 being directly accelerated to the second speed. Because the above operations are not able to be performed indefinitely, when the first measured value is greater than the first reference value even when the second time, which is the time elapsed after the first time, has elapsed, the control method of the present disclosure may no longer measure the first measured value again (S150) and no longer compare the first measured value with the first reference value again (S170), and may proceed to the second maintaining operation (S210) of maintaining the second speed after accelerating the rotation speed of the drum 3 to the preset second speed. This is because not only the first measured value is used to predict the degree of the occurrence of the unbalance in the dehydration operation, but also the laundry may be dispersed to some extent while maintaining the rotation of the drum 3 at the first speed for the first time and the second time.

That is, the reason for passing the first speed without directly accelerating the drum 3 to the second speed is that the laundry may be dispersed by repeatedly being lifted and dropped by the rotation of the drum 3 at the first speed during the time combining the first time and the second time.

The second time may be preferably set to 5 seconds. Accordingly, the first measured value may be a UBVMA value for a maximum of 5 seconds. In addition, even before reaching the second time, when the laundry is dispersed, the re-measured first measured value may be equal to or smaller than the first reference value, which means that the magnitude of the unbalance is small, so that the control method of the present disclosure may directly accelerate the drum 3 to the second speed (S210).

The second speed may be set to a speed at which the laundry is attached to the inner wall of the drum 3 and rotates together and may be preferably set to 58 RPM.

The second maintaining operation (S210) of accelerating the drum 3 from the first speed to the second speed and maintaining the second speed is an operation required to stably rotate the drum 3 at the second speed. This is because, when the drum 3 is accelerated from the first speed to the second speed, the second speed is not reached immediately, but the second speed is reached after going through fluctuation to some extent. Accordingly, a third time for the drum 3 to stably rotate at the second speed may be required.

The third time may mean a time required to stabilize the drum 3 at the second speed, and may preferably be set in a range from 1 second to 3 seconds. This is because, when the third time is set to be shorter than 1 second, a time is insufficient for the stabilization, and when the third time is set to be longer than 3 seconds, the dehydration time may become unintentionally long. In addition, the second speed may be set to be lower than the third speed, which is the rotation speed during the dehydration operation (S600), and may be preferably 58 RPM.

Therefore, the control method of the present disclosure may proceed with the second maintaining operation (S210) of maintaining the drum 3 at the second speed until the third time elapses (S230) after reaching the second speed.

After the third time elapses, the control method of the present disclosure may proceed to a second measurement operation (S250) of measuring the magnitude of the unbalance of the drum 3 (the second measured value). When the second measured value is equal to or smaller than the second reference value (S270), the control method of the present disclosure may stop the rotation of the drum 3 (S300).

However, when the second measured value exceeds the second reference value (S270), the control method of the present disclosure may repeatedly perform the second measurement operation (S250) and the operation (S270) of determining whether the second measured value is equal to or smaller than the second reference value (S270) when a time elapsed after the third time has elapsed is less than a preset fourth time (S280).

Even when the second measured value exceeds the second reference value (S270), when the time elapsed after the third time has elapsed reaches the preset fourth time (S280), the control method of the present disclosure may no longer repeat the second measurement operation (S250) and the operation of determining whether the second measured value is equal to or less than the second reference value (S270), and may stop the rotation of the drum 3 (S300).

Preferably, as described above, the second measured value may be a second unbalanced value of moving average (UBVMA) calculated using the speed UB, and the second reference value may also be a preset second reference unbalanced value of moving average (UBVMA). The second reference unbalanced value of moving average (UBVMA) may be preferably 150 A.U. The A.U is an arbitrary unit that may vary depending on the method for processing the measured value, but the unbalanced value of moving average may preferably be the value obtained by converting the speed value into the current value. Therefore, the unit of the unbalanced value of moving average may be A (ampere) or mA (milliampere), which is the unit of the current value.

The second reference unbalanced value of moving average (UBVMA) may be set smaller than the first reference unbalanced value of moving average (UBVMA). This is because the second speed is higher than the first speed, and thus, at the second speed, unlike at the first speed, the laundry may be dispersed better as the laundry is attached to the inner wall of the drum 3 and rotates together. Accordingly, the second reference unbalanced value of moving average (UBVMA) may be set to a value smaller than the first reference unbalanced value of moving average (UBVMA).

The fourth time may be preferably set to 5 seconds. Accordingly, the second measured value may be a UBVMA value for a maximum of 5 seconds. In addition, even before reaching the fourth time, when the laundry is dispersed, the re-measured second measured value may be equal to or smaller than the second reference value, which means that the magnitude of the unbalance is small, so that the control method of the present disclosure may directly stop the rotation of the drum 3 (S300).

This is because, when the drum 3 rotates at the second speed, the second measured value is already equal to or smaller than the second reference value, and thus, there is no need to maintain the rotation at the second speed anymore.

After stopping the rotation of the drum 3, in order to determine the degree of the occurrence of the unbalance, the control method of the present disclosure may repeat the first maintaining operation (S110), the first measurement operation (S150), the second maintaining operation (S210), the second measurement operation (S250), and the operation (S300) of stopping the rotation of the drum 3 as much as a preset number of repetitions (S400).

During the repetition, a preset waiting time may be set between two sets of repetition. That is, the control method of the present disclosure does not proceed to the first maintaining operation (S110) immediately after stopping the rotation of the drum 3, but starts again from the first maintaining operation (S110) after waiting for the waiting time.

When the number of repetitions is set to 2, when describing only a rotation state of the drum 3, the rotation state of the drum 3 may be changed in an order of the stop, the first-speed rotation, the second-speed rotation, the rotation stop, the waiting time, the first-speed rotation, the second-speed rotation, and the stop.

In one example, the repetition may be made with the fact that the first maintaining operation (S110) is maintained for the first time (S130), the first measurement operation is maintained up to the second time (S180), and, when the first measured value is equal to or smaller than the first reference value (S170) even before reaching the second time, the control method of the present disclosure proceeds to the second maintaining operation (S210), as described above.

In addition, the repetition may be made with the fact that the second maintaining operation (S230) is maintained for the third time (S130), the second measurement operation is maintained up to the fourth time (S280), and, when the second measured value is equal to or smaller than the second reference value (S270) even before reaching the fourth time, the control method of the present disclosure proceeds to the operation (S300) of stopping the drum 3, as described above.

The number of repetitions may be preferably set to 4. During the repetition for the preset number of repetitions, the number of times the second measured value is equal to or smaller than the second reference value is counted and referred to as the first number of times. Accordingly, the first number of times means the total number of times the second measured value is equal to or smaller than the second reference value in the UB predicting operation (S30) (see FIG. 2).

The control method of the present disclosure may set the unbalance reference value to be used in the dehydration operation based on the first number of times. That is, the unbalance reference value to be used in the dehydration operation may be set based on the second measured value. For example, when the first number of times is 0 during the 4 repetitions, it may be determined that the cloth has the great amount of UB. In this case, the control method of the present disclosure may loosely set the unbalance reference value to be used in the dehydration operation (S600) of rotating the drum 3 at the third speed preset to be higher than the first speed or the second speed such that some degree of UB is accepted. Alternatively, the unbalance reference value may be set such that the dispersion of the cloths in the dehydration entry operation is performed more.

This has an effect of saving time than a case of entering the dehydration entry operation again after decelerating or stopping the rotation of the drum 3 when the unbalance reference value is fixedly used or when the magnitude of the unbalance exceeds the unbalance reference value in the dehydration entry operation because the cloths are not sufficiently dispersed. In addition, there is an effect of reducing the vibration and the noise.

One embodiment of the determination method is summarized in Table 1 below. In addition, because the dehydration operation (S600) is performed only once, the dehydration operation (S600) corresponds to the main dehydration, not the simple dehydration.

TABLE 1

| Number of dehydrations and number of repetitions | First number of times or sum of first number of times and second number of times | Cloth determination |
|---|---|---|
| When number of dehydrations is 1 (number of repetitions = 4) | 0 | Cloth with great amount of UB |
| | Equal to or greater than 2 | Cloth with intermediate amount of UB |
| | Equal to or greater than 3 | Cloth with small amount of UB |
| Total of 6 times, sum of first number of repetitions 3 and second number of repetitions 3, when number of dehydrations is 2 | 0 | Cloth with great amount of UB |
| | Equal to or smaller than 3 | Cloth with intermediate amount of UB |
| | Equal to or greater than 4 | Cloth with small amount of UB |

That is, when the number of dehydrations is 1 and the number of repetitions is set to 4, a case in which the first number of times is 0 is a case in which the second measured value is not equal to or smaller than the second reference value. Therefore, the cloth may be determined as the cloth with the large amount of UB. In this case, the control method of the present disclosure may loosely set the unbalance reference value to be used in the dehydration operation (S600) of rotating the drum 3 at the third speed preset to be higher than the first speed or the second speed such that some degree of UB is accepted. Alternatively, the unbalance reference value may be set such that the dispersion of the cloths in the dehydration entry operation is performed more.

When the first number of repetitions is equal to or smaller than 2, that is, is 1 or 2, the cloth may be determined as the cloth with the intermediate amount of UB. In addition, when the first number of repetitions is equal to or greater than 3, that is, is 3 or 4, the cloth may be determined as the cloth with the small amount of UB. In this case, the unbalance reference value to be used in the dehydration operation (S600) may be strictly set. This is because the time in the dehydration entry operation may be reduced as the cloths are already well dispersed or the moisture content is low. This is merely one embodiment, and another determination method is able to be used when the degree of the occurrence of the UB is able to be predicted.

Figure 5:
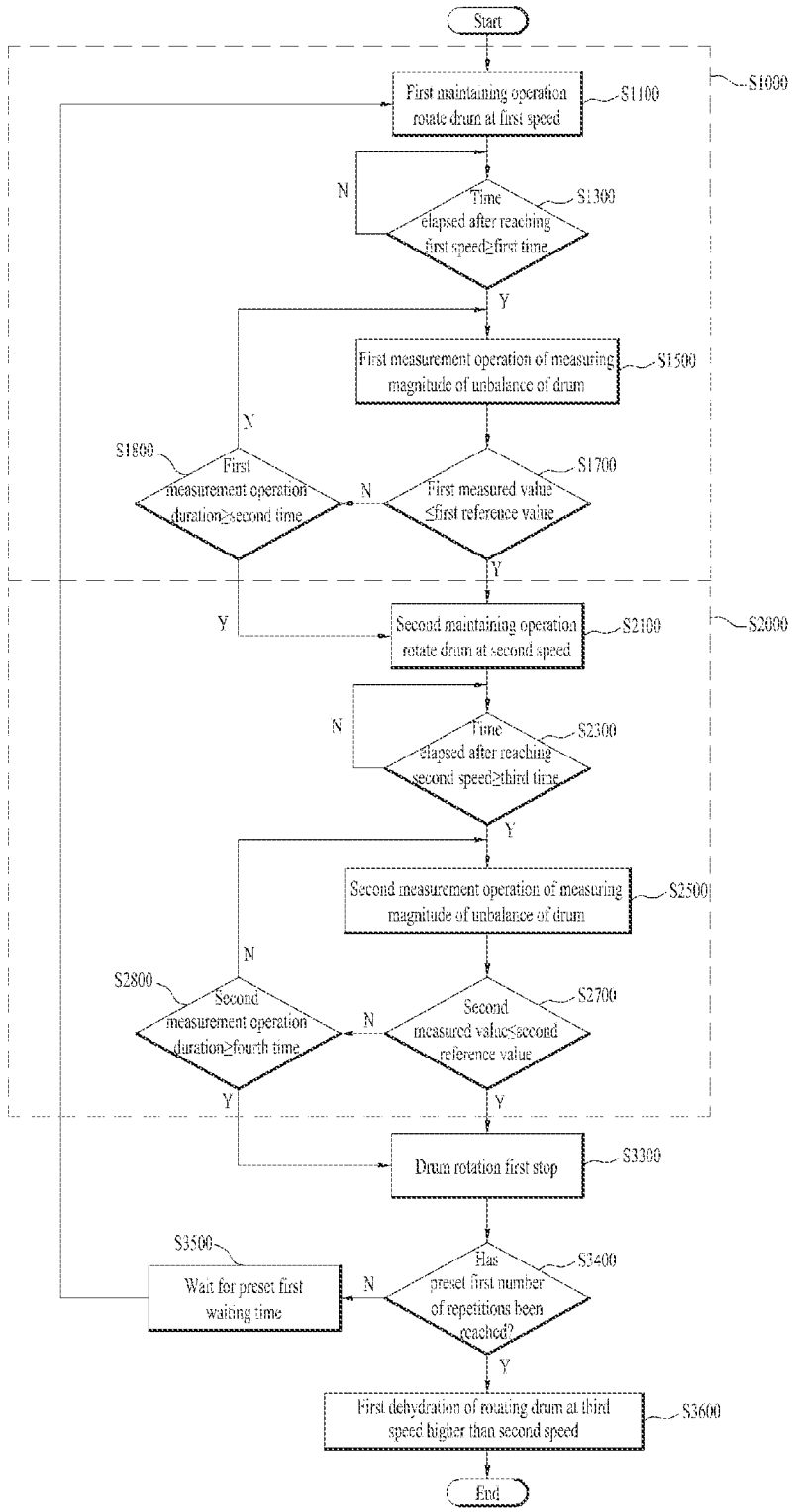
FIG. 5 is a flowchart illustrating an example of a control method before first dehydration of a method for controlling a laundry treating apparatus according to the present disclosure of when a user automatically selects a washing process.

FIG. 5 shows an embodiment of the present disclosure of predicting first UB when a laundry treating apparatus automatically performs a course selected in response to course selection of a user by a controller. Unlike the case in which the rinsing process is selected, each of the rinsing process and the dehydration process may be performed two times.

An example of the control method of the present disclosure is largely composed of, after the first foreign substance separation operation of rotating the drum 3 rotatably disposed inside the tub 2 in which the water is stored to rub the laundry inside the drum 3 with the water and the first draining operation of draining the water inside the tub 2 to the outside of the tub 2, an operation (S1000) of measuring the first measured value that is the UB value of the drum 3 while maintaining the drum 3 at the preset first speed and comparing the first measured value with the preset first reference value, an operation (S2000) of measuring the second measured value that is the UB value of the drum 3 while maintaining the drum 3 at the preset second speed and comparing the second measured value with the preset second reference value, a first stop operation (S3000) of stopping the rotation of the drum 3, a first dehydration operation (S3600) of dehydrating the drum 3 at the preset third speed higher than the second speed, an operation (S4000) of measuring the third measured value that is the UB value of the drum 3 while maintaining the drum 3 at the preset third speed and comparing the third measured value with the preset third reference value, an operation (S5000) of measuring the fourth measured value that is the UB value of the drum 3 while maintaining the drum 3 at the preset fourth speed and comparing the fourth measured value with the preset fourth reference value, a second stop operation (S6300) of stopping the rotation of the drum 3, and a second dehydration operation (S6600) of setting the UB reference value in the dehydration operation to be performed later based on the second measured value and the fourth measured value and dehydrating the drum 3 at a preset sixth speed higher than the third speed.

Herein, the first speed may be the speed at which the drum 3 is rotated in order to disperse the laundry inside the drum 3 before rotating the drum 3 at the second speed. Preferably the first speed may be set to 42 RPM. The second speed may be the rotation speed of the drum 3 used to measure the occurrence of the unbalance when the drum 3 rotates.

Preferably the second speed may be 58 RPM. The third speed is the rotation speed used in the first dehydration operation.

The fourth speed may be the speed at which the drum 3 is rotated in order to disperse the laundry inside the drum 3 before rotating the stopped drum 3 at the fifth speed. Preferably the fourth speed may be set to 42 RPM. The fifth speed may be the rotation speed of the drum 3 used to measure the occurrence of the unbalance when the drum 3 rotates. Preferably the fifth speed may be 58 RPM. The sixth speed is the rotation speed used in the final second dehydration operation.

The first measured value is the value obtained by measuring the magnitude of unbalance that occurs when the drum 3 rotates at the first speed, and the first reference value is the preset value that the first measured value must satisfy. The second measured value is the value obtained by measuring the magnitude of unbalance that occurs when the drum 3 rotates at the second speed, and the second reference value is the preset value that the second measured value must satisfy.

The third measured value is a value obtained by measuring a magnitude of unbalance that occurs when the drum 3 rotates at the fourth speed, and the third reference value is a preset value that the third measured value must satisfy. The fourth measured value is the value obtained by measuring a magnitude of unbalance that occurs when the drum 3 rotates at the fifth speed, and the fourth reference value is the preset value that the fourth measured value must satisfy.

In one embodiment of the present disclosure, the first speed and the fourth speed may be the same, and the second speed and the fifth speed may be the same. The first reference value and the third reference value may be the same, and the second reference value and the fourth reference value may be the same.

Specifically, referring to FIG. 2, the control method of the present disclosure may include the first foreign substance separation operation (S15), the first draining operation (S25), the first UB predicting operation (S35) of predicting the degree of the occurrence of the UB in order to set the UB reference value required in the second dehydration operation, the first dehydration operation (S45) of accelerating the drum 3 to the third speed set higher than the second speed to remove the water from the laundry, the water supply operation (S55) of supplying the water to the tub 2, the second foreign substance separation operation (S65) of rotating the drum 3 rotatably disposed inside the tub 2 to rub the laundry inside the drum 3 with the water, the second draining operation (S75) of draining the water inside the tub 2 to the outside of the tub 2, the second UB predicting operation (S85) of predicting the degree of the occurrence of the UB in order to set the UB reference value required in the second dehydration operation, and the second dehydration operation (S95) based on the UB reference value.

Referring to FIG. 5, the first UB predicting operation (S35, FIG. 2) may include a first maintaining operation (S1100) of maintaining the first speed after the rotation speed of the drum 3 reaches the preset first speed, a first measurement operation (S1500) of measuring the magnitude of the unbalance occurring in the drum 3 while the drum 3 rotates at the first speed, a second maintaining operation (S2100) of maintaining the second speed after accelerating the rotation speed of the drum 3 to the preset second speed when the first measured value measured in the first measurement operation is equal to or smaller than the preset first reference value (S1700), a second measurement operation (S2500) of measuring the magnitude of the unbalance occurring in the drum 3 while the drum 3 rotates at the second speed, and a first stop operation (S3300) of stopping the rotation of the drum 3 when the second measured value measured in the second measurement operation (S2500) is equal to or smaller than the preset second reference value (S2700).

Figure 6:
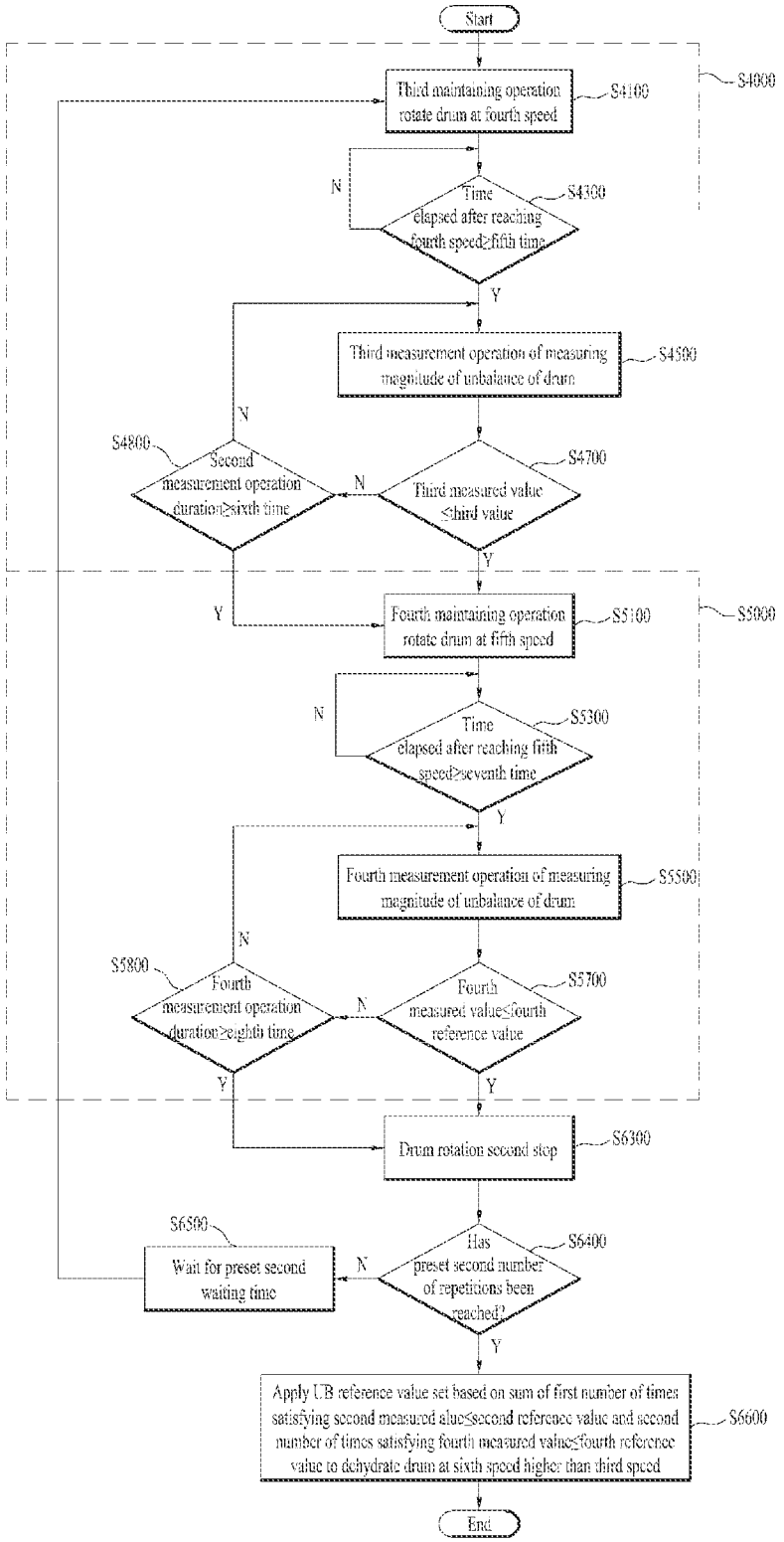
FIG. 6 is a flowchart illustrating an example of a control method before second dehydration of a method for controlling a laundry treating apparatus according to the present disclosure of when a user automatically selects a washing process.

Referring to FIG. 6, the second UB predicting operation (S85) (see FIG. 2) may include a third maintaining operation (S4100) of maintaining the fourth speed after the rotation speed of the drum 3 reaches the preset fourth speed, a third measurement operation (S4500) of measuring the magnitude of the unbalance occurring in the drum 3 while the drum 3 rotates at the fourth speed, a fourth maintaining operation (S5100) of maintaining the fifth speed after accelerating the rotation speed of the drum 3 to the preset fifth speed when the third measured value measured in the third measurement operation is equal to or smaller than the preset third reference value (S4700), a fourth measurement operation (S5500) of measuring the magnitude of the unbalance occurring in the drum 3 while the drum 3 rotates at the fifth speed, and a second stop operation (S6300) of stopping the rotation of the drum 3 when the fourth measured value measured in the fourth measurement operation is equal to or smaller than the preset fourth reference value (S5700).

Thereafter, the control method of the present disclosure may proceed with the second dehydration operation of accelerating the drum 3 to the sixth speed set higher than the third speed to remove the water from the laundry, the second dehydration operation (S6600) may be stopped when the magnitude of the unbalance of the drum 3 measured while accelerating the drum 3 to the sixth speed is greater than the preset unbalance reference value, and the unbalance reference value may be set based on the second measured value and the fourth measured value.

FIG. 5 shows an embodiment of the first UB predicting operation (S35) (see FIG. 2), and FIG. 6 shows an embodiment of the second UB predicting operation (S85) (see FIG. 2).

After the foreign substance separation operation (S15) (see FIG. 2) of rotating the drum 3 that is rotatably disposed inside the tub 2 in which the water is stored to cause the friction between the laundry inside the drum 3 and the water and the second draining operation (S25) (see FIG. 2) of draining the water inside the tub 2 to the outside of the tub 2, the control method of the present disclosure may perform the first maintaining operation (S110) of maintaining the first speed after the rotation speed of the drum 3 reaches the preset first speed.

The first maintaining operation (S1100) is an operation required to stably rotate the drum 3 at the first speed. This is because, when the drum 3 is accelerated from the stop state to the first speed, the rotation speed does not reach the first speed immediately, but reaches the first speed after going through the fluctuation to some extent. Accordingly, the first time may be required for the drum 3 to stably rotate at the first speed.

The first time may preferably be set in the range from 1 second to 3 seconds. This is because, when the first time is set to be shorter than 1 second, the time is insufficient for the stabilization, and when the first time is set to be longer than 3 seconds, the dehydration time may become unintentionally long. In addition, the first speed as the rotation speed set to be lower than the third speed, which is the rotation speed during the dehydration operation (S600), may be preferably 42 RPM.

Therefore, the control method of the present disclosure may proceed with the first maintaining operation (S1100) of maintaining the drum 3 at the first speed until the first time elapses (S1300) after reaching the first speed.

After the first time elapses, the control method of the present disclosure may proceed to a first measurement operation (S1500) of measuring the magnitude of the unbalance of the drum 3 (the first measured value). When the first measured value is equal to or smaller than the first reference value (S1700), the control method of the present disclosure may proceed to a second maintaining operation (S2100) of maintaining the second speed after accelerating the rotation speed of the drum 3 to the preset second speed.

However, when the first measured value exceeds the first reference value (S1700), the control method of the present disclosure may repeatedly perform the first measurement operation (S1500) and the operation (S1700) of determining whether the first measured value is equal to or smaller than the first reference value when a time elapsed after the first time has elapsed is less than a preset second time (S1800).

Even when the first measured value exceeds the first reference value (S1700), when the time elapsed after the first time has elapsed reaches the preset second time (S1800), the control method of the present disclosure may no longer repeat the first measurement operation (S1500) and the operation (S1700) of determining whether the first measured value is equal to or less than the first reference value, and may proceed to a second maintaining operation (S2100) of maintaining the second speed after accelerating the rotation speed of the drum 3 to the preset second speed.

Preferably, as described above, the first measured value may be the first unbalanced value of moving average (UBVMA) calculated using the speed UB, and the first reference value may also be the preset first reference unbalanced value of moving average (UBVMA). The first reference unbalanced value of moving average (UBVMA) may be preferably 200 A.U. the A.U is the arbitrary unit that may vary depending on the method for processing the measured value, but the unbalanced value of moving average may preferably be the value obtained by converting the speed value into the current value. Therefore, the unit of the unbalanced value of moving average may be A (ampere) or mA (milliampere), which is the unit of the current value.

The reason why the control method of the present disclosure stabilizes the drum 3 at the first speed for the first time without immediately accelerating the drum 3 from the stop state to the second speed and then proceeds to the second maintaining operation (S2100) immediately when the first measured value, which is the measured UB value, is equal to or smaller than the first reference value within the second time after the first time has elapsed is that the unbalance does not occur much at the first speed because the first measured value is equal to or smaller than the first reference value. Therefore, in order to measure the second measured value, which is the measured value actually used to predict the occurrence of unbalance, the controller directly accelerates the drum 3 to the second speed.

However, when the first measured value is greater than the first reference value, it means that the great amount of unbalance occurs at the first speed. Therefore, the first measured value is continuously measured again (S1500) and is compared with the first reference value again (S1700) without the drum 3 being directly accelerated to the second speed. Because the above operations are not able to be performed indefinitely, when the first measured value is greater than the first reference value even when the second time, which is the time elapsed after the first time, has elapsed, the control method of the present disclosure may no longer measure the first measured value again (S1500) and no longer compare the first measured value with the first reference value again (S1700), and may proceed to the second maintaining operation (S2100) of maintaining the second speed after accelerating the rotation speed of the drum 3 to the preset second speed. This is because not only the first measured value is used to predict the degree of the occurrence of the unbalance in the dehydration operation, but also the laundry may be dispersed to some extent while maintaining the rotation of the drum 3 at the first speed for the first time and the second time.

That is, the reason for passing the first speed without directly accelerating the drum 3 to the second speed is that the laundry may be dispersed by repeatedly being lifted and dropped by the rotation of the drum 3 at the first speed during the time combining the first time and the second time.

The second time may be preferably set to 5 seconds. Accordingly, the first measured value may be the UBVMA value for the maximum of 5 seconds. In addition, even before reaching the second time, when the laundry is dispersed, the re-measured first measured value may be equal to or smaller than the first reference value, which means that the magnitude of the unbalance is small, so that the control method of the present disclosure may directly accelerate the drum 3 to the second speed (S2100).

The second speed may be set to the speed at which the laundry is attached to the inner wall of the drum 3 and rotates together and may be preferably set to 58 RPM.

The second maintaining operation (S2100) of accelerating the drum 3 from the first speed to the second speed and maintaining the second speed is an operation required to stably rotate the drum 3 at the second speed. This is because, when the drum 3 is accelerated from the first speed to the second speed, the second speed is not reached immediately, but the second speed is reached after going through fluctuation to some extent. Accordingly, the third time for the drum 3 to stably rotate at the second speed may be required.

The third time may mean the time required to stabilize the drum 3 at the second speed, and may preferably be set in the range from 1 second to 3 seconds. This is because, when the third time is set to be shorter than 1 second, the time is insufficient for the stabilization, and when the third time is set to be longer than 3 seconds, the dehydration time may become unintentionally long. In addition, the second speed may be set to be lower than the third speed, which is the rotation speed during the dehydration operation (S600), and may be preferably 58 RPM.

Therefore, the control method of the present disclosure may proceed with the second maintaining operation (S2100) of maintaining the drum 3 at the second speed until the third time elapses (S2300) after reaching the second speed.

After the third time elapses, the control method of the present disclosure may proceed to a second measurement operation (S2500) of measuring the magnitude of the unbalance of the drum 3 (the second measured value). When the second measured value is equal to or smaller than the second reference value (S2700), the control method of the present disclosure may stop the rotation of the drum 3 (S3000).

However, when the second measured value exceeds the second reference value (S2700), the control method of the present disclosure may repeatedly perform the second measurement operation (S2500) and the operation (S2700) of determining whether the second measured value is equal to or smaller than the second reference value when a time elapsed after the third time has elapsed is less than a preset fourth time (S2800).

Even when the second measured value exceeds the second reference value (S2700), when the time elapsed after the third time has elapsed reaches the preset fourth time (S2800), the control method of the present disclosure may no longer repeat the second measurement operation (S2500) and the operation (S2700) of determining whether the second measured value is equal to or less than the second reference value, and may stop the rotation of the drum 3 (S3300).

Preferably, as described above, the second measured value may be the second unbalanced value of moving average (UBVMA) calculated using the speed UB, and the second reference value may also be the preset second reference unbalanced value of moving average (UBVMA). The second reference unbalanced value of moving average (UBVMA) may be preferably 150 A.U. The A.U is the arbitrary unit that may vary depending on the method for processing the measured value, but the unbalanced value of moving average may preferably be the value obtained by converting the speed value into the current value. Therefore, the unit of the unbalanced value of moving average may be A (ampere) or mA (milliampere), which is the unit of the current value.

The second reference unbalanced value of moving average (UBVMA) may be set smaller than the first reference unbalanced value of moving average (UBVMA). This is because the second speed is higher than the first speed, and thus, at the second speed, unlike at the first speed, the laundry may be dispersed better as the laundry is attached to the inner wall of the drum 3 and rotates together. Accordingly, the second reference unbalanced value of moving average (UBVMA) may be set to a value smaller than the first reference unbalanced value of moving average (UBVMA).

The fourth time may be preferably set to 5 seconds. Accordingly, the second measured value may be the UBVMA value for the maximum of 5 seconds. In addition, even before reaching the fourth time, when the laundry is dispersed, the re-measured second measured value may be equal to or smaller than the second reference value, which means that the magnitude of the unbalance is small, so that the control method of the present disclosure may directly stop the rotation of the drum 3 (S3300).

This is because, when the drum 3 rotates at the second speed, the second measured value is already equal to or smaller than the second reference value, and thus, there is no need to maintain the rotation at the second speed anymore.

After stopping the rotation of the drum 3, in order to determine the degree of the occurrence of the unbalance, the control method of the present disclosure may repeat the first maintaining operation (S1100), the first measurement operation (S1500), the second maintaining operation (S2100), the second measurement operation (S2500), and the first stop operation (S3300) of stopping the rotation of the drum 3 as much as the first number of repetitions (S3400).

During the repetition, the preset waiting time may be set between two sets of repetition. That is, the control method of the present disclosure does not proceed to the first maintaining operation (S1100) immediately after stopping the rotation of the drum 3, but starts again from the first maintaining operation (S1100) after waiting for the waiting time.

When the number of repetitions is set to 2, when describing only the rotation state of the drum 3, the rotation state of the drum 3 may be changed in an order of the stop, the first-speed rotation, the second-speed rotation, the first stop, the first waiting time, the first-speed rotation, the second-speed rotation, and the first stop.

In one example, the repetition may be made with the fact that the first maintaining operation (S1100) is maintained for the first time (S1300), the first measurement operation is maintained up to the second time (S1800), and, when the first measured value is equal to or smaller than the first reference value (S1700) even before reaching the second time, the control method of the present disclosure proceeds to the second maintaining operation (S2100), as described above.

In addition, the repetition may be made with the fact that the second maintaining operation (S2100) is maintained for the third time (S2300), the second measurement operation (S2500) is maintained up to the fourth time (S1800), and, when the second measured value is equal to or smaller than the second reference value (S1700) even before reaching the fourth time, the control method of the present disclosure proceeds to the operation (S3300) of stopping the drum 3, as described above.

The first number of repetitions may be preferably set to 3. During the repetition for the first number of repetitions, the number of times the second measured value is equal to or smaller than the second reference value is counted and referred to as the first number of times. Accordingly, the first number of times means the total number of times the second measured value is equal to or smaller than the second reference value in the first UB predicting operation (S35) (see FIG. 2).

In addition, during the repetition, the preset first waiting time may be set between two sets of repetition. That is, the control method of the present disclosure may wait for the first waiting time before initiating the first maintaining operation (S1100) again after stopping the drum 3 (S3300).

Thereafter, the control method of the present disclosure initiates a first dehydration operation (S3600) of rotating the drum 3 at the preset third speed higher than the second speed.

In the case of the first dehydration operation (S3600), the drum 3 is rotated at the high speed such that the water soaked in the laundry flows out. When the controller drives the drum driver 35 to rotate the drum 3 at the high speed, the laundry rotates while being attached to the inner wall of the drum 3, so that the cloth is dehydrated by the centrifugal force. However, the first dehydration operation (S3600) is not required to dehydrate the laundry to the extent that the laundry is dried. In addition, it is sufficient when the drum 3 rotates at the rotation speed at which the laundry rotates while being attached to the inner wall of the drum 124 such that the high concentration of laundry detergent remains in the cloth. Preferably, the rotation speed in the first dehydration operation (S3600) may be set to be equal to or higher than 100 RPM and equal to or lower than 1000 RPM.

After the first dehydration operation, the control method of the present disclosure proceeds to the water supply operation (S55) (see FIG. 2) of supplying the water to the tub 2, the second foreign substance separation operation (S65) (see FIG. 2) of rotating the drum 3 rotatably disposed inside the tub 2 to rub the laundry inside the drum 3 with the water, and the second draining operation (S75) (see FIG. 2) of draining the water inside the tub 2 to the outside of the tub 2. Thereafter, the control method of the present disclosure proceeds to the second UB predicting operation (S85) (see FIG. 2).

Referring to FIG. 6, the second UB predicting operation (S85) (see FIG. 2) may include the third maintaining operation (S4100) of maintaining the fourth speed after the rotation speed of the drum 3 reaches the preset fourth speed, the third measurement operation (S4500) of measuring the magnitude of the unbalance occurring in the drum 3 while the drum 3 rotates at the fourth speed, the fourth maintaining operation (S5100) of maintaining the fifth speed after accelerating the rotation speed of the drum 3 to the preset fifth speed when the third measured value measured in the third measurement operation is equal to or smaller than the preset third reference value (S4700), the fourth measurement operation (S5500) of measuring the magnitude of the unbalance occurring in the drum 3 while the drum 3 rotates at the fifth speed, and the second stop operation (S6300) of stopping the rotation of the drum 3 when the fourth measured value measured in the fourth measurement operation is equal to or smaller than the preset fourth reference value (S5700).

Thereafter, the control method of the present disclosure may proceed with the second dehydration operation (S6600) of accelerating the drum 3 to the sixth speed set higher than the third speed to remove the water from the laundry, the second dehydration operation (S6600) may be stopped when the magnitude of the unbalance of the drum 3 measured while accelerating the drum 3 to the sixth speed is greater than the preset unbalance reference value, and the unbalance reference value may be set based on the second measured value and the fourth measured value.

When a more detailed description is made using FIG. 6, the third maintaining operation (S4100) is an operation required to stably rotate the drum 3 at the fourth speed. This is because, when the drum 3 is accelerated from the stop state to the fourth speed, the rotation speed does not reach the fourth speed immediately, but reaches the fourth speed after going through the fluctuation to some extent. Accordingly, the fifth time may be required for the drum 3 to stably rotate at the fourth speed.

The fifth time may preferably be set in the range from 1 second to 3 seconds. This is because, when the fifth time is set to be shorter than 1 second, the time is insufficient for the stabilization, and when the fifth time is set to be longer than 3 seconds, the dehydration time may become unintentionally long. In addition, the fifth speed as the rotation speed set to be lower than the third speed and the sixth speed, which are the rotation speeds during the two dehydration operations (S3600 and S6000), may be preferably 42 RPM. Accordingly, the first speed and the fourth speed may be set to be the same.

Therefore, the control method of the present disclosure may proceed with the third maintaining operation (S4100) of maintaining the drum 3 at the fourth speed until the fifth time elapses (S4300) after reaching the fourth speed.

After the fifth time elapses, the control method of the present disclosure may proceed to a third measurement operation (S4500) of measuring the magnitude of the unbalance of the drum 3 (the third measured value). When the third measured value is equal to or smaller than the third reference value (S4700), the control method of the present disclosure may proceed to a fourth maintaining operation (S6100) of maintaining the fifth speed after accelerating the rotation speed of the drum 3 to the preset fifth speed.

However, when the third measured value exceeds the third reference value (S4700), the control method of the present disclosure may repeatedly perform the third measurement operation (S4500) and the operation (S4700) of determining whether the third measured value is equal to or smaller than the third reference value when a time elapsed after the fifth time has elapsed is less than a preset sixth time (S4800).

Even when the third measured value exceeds the third reference value (S4700), when the time elapsed after the fifth time has elapsed reaches the preset sixth time (S4800), the control method of the present disclosure may no longer repeat the third measurement operation (S4500) and the operation (S4700) of determining whether the third measured value is equal to or less than the third reference value, and may proceed to a fourth maintaining operation (S5100) of maintaining the fifth speed after accelerating the rotation speed of the drum 3 to the preset fifth speed.

Preferably, as described above, the third measured value may be the third unbalanced value of moving average (UBVMA) calculated using the measured speed UB, and the third reference value may also be the preset third reference unbalanced value of moving average (UBVMA). The third reference unbalanced value of moving average (UBVMA) may be preferably 200 A.U. The A.U is the arbitrary unit that may vary depending on the method for processing the measured value, but the unbalanced value of moving average may preferably be the value obtained by converting the speed value into the current value. Therefore, the unit of the unbalanced value of moving average may be A (ampere) or mA (milliampere), which is the unit of the current value.

The reason why the control method of the present disclosure stabilizes the drum 3 at the fourth speed for the first time without immediately accelerating the drum 3 from the stop state to the fifth speed and then proceeds to the fourth maintaining operation (S5100) immediately when the third measured value, which is the measured UB value, is equal to or smaller than the third reference value within the sixth time after the fifth time has elapsed is that the unbalance does not occur much at the fourth speed because the third measured value is equal to or smaller than the third reference value. Therefore, in order to measure the fourth measured value, which is the measured value actually used to predict the occurrence of unbalance, the controller directly accelerates the drum 3 to the second speed.

However, when the third measured value is greater than the third reference value, it means that the great amount of unbalance occurs at the fourth speed. Therefore, the third measured value is continuously measured again (S4500) and is compared with the third reference value again (S4700) without the drum 3 being directly accelerated to the fifth speed. Because the above operations are not able to be performed indefinitely, when the third measured value is greater than the third reference value even when the sixth time, which is the time elapsed after the fifth time, has elapsed, the control method of the present disclosure may no longer measure the third measured value again (S4500) and no longer compare the third measured value with the third reference value again (S4700), and may proceed to the fourth maintaining operation (S5100) of maintaining the fifth speed after accelerating the rotation speed of the drum 3 to the preset fifth speed. This is because not only the third measured value is used to predict the degree of the occurrence of the unbalance in the dehydration operation, but also the laundry may be dispersed to some extent while maintaining the rotation of the drum 3 at the fourth speed for the fifth time and the sixth time.

That is, the reason for passing the fourth speed without directly accelerating the drum 3 to the fifth speed is that the laundry may be dispersed by repeatedly being lifted and dropped by the rotation of the drum 3 at the fourth speed during the time combining the fifth time and the sixth time.

The fifth time may be preferably set to 5 seconds. Accordingly, the third measured value may be the UBVMA value for the maximum of 5 seconds. In addition, even before reaching the fifth time, when the laundry is dispersed, the re-measured third measured value may be equal to or smaller than the third reference value, which means that the magnitude of the unbalance is small, so that the control method of the present disclosure may directly accelerate the drum 3 to the fifth speed (S2100).

The fifth speed may be set to the speed at which the laundry is attached to the inner wall of the drum 3 and rotates together and may be preferably set to 58 RPM. Accordingly, preferably, the second speed and the fifth speed may be set to the same value.

The fourth maintaining operation (S5100) of accelerating the drum 3 from the fourth speed to the fifth speed and maintaining the fifth speed is an operation required to stably rotate the drum 3 at the fifth speed. This is because, when the drum 3 is accelerated from the fourth speed to the fifth speed, the fifth speed is not reached immediately, but the fifth speed is reached after going through fluctuation to some extent. Accordingly, the sixth time for the drum 3 to stably rotate at the fifth speed may be required.

The seventh time may mean a time required to stabilize the drum 3 at the fifth speed, and may preferably be set in the range from 1 second to 3 seconds. This is because, when the seventh time is set to be shorter than 1 second, the time is insufficient for the stabilization, and when the seventh time is set to be longer than 3 seconds, the dehydration time may become unintentionally long.

Therefore, the control method of the present disclosure may proceed with the second maintaining operation (S510) of maintaining the drum 3 at the fifth speed until the seventh time elapses (S5300) after reaching the fifth speed.

After the third time elapses, the control method of the present disclosure may proceed to a fourth measurement operation (S5500) of measuring the magnitude of the unbalance of the drum 3 (the fourth measured value). When the fourth measured value is equal to or smaller than the fourth reference value (S5700), the control method of the present disclosure may proceed to a second stop operation (S6300) of stopping the rotation of the drum 3.

However, when the fourth measured value exceeds the fourth reference value (S5700), the control method of the present disclosure may repeatedly perform the fourth measurement operation (S5500) and the operation (S5700) of determining whether the fourth measured value is equal to or smaller than the fourth reference value when a time elapsed after the eighth time has elapsed is less than a preset eighth time (S5800).

Even when the fourth measured value exceeds the fourth reference value (S5700), when the time elapsed after the seventh time has elapsed reaches the preset eighth time (S5800), the control method of the present disclosure may no longer repeat the fourth measurement operation (S5500) and the operation (S5700) of determining whether the fourth measured value is equal to or less than the fourth reference value, and may proceed to the second stop operation (S6300) of stopping the rotation of the drum 3.

Preferably, as described above, the fourth measured value may be the fourth unbalanced value of moving average (UBVMA) calculated using the measured speed UB, and the fourth reference value may also be the preset fourth reference unbalanced value of moving average (UBVMA). The fourth reference unbalanced value of moving average (UBVMA) may be preferably 150 A.U. The A.U is the arbitrary unit that may vary depending on the method for processing the measured value, but the unbalanced value of moving average may preferably be the value obtained by converting the speed value into the current value. Therefore, the unit of the unbalanced value of moving average may be A (ampere) or mA (milliampere), which is the unit of the current value.

The fourth reference unbalanced value of moving average (UBVMA) may be set smaller than the third reference unbalanced value of moving average (UBVMA). This is because the fifth speed is higher than the fourth speed, and thus, at the fifth speed, unlike at the fourth speed, the laundry may be dispersed better as the laundry is attached to the inner wall of the drum 3 and rotates together. Accordingly, the fourth reference unbalanced value of moving average (UBVMA) may be set to a value smaller than the third reference unbalanced value of moving average (UBVMA).

The eighth time may be preferably set to 5 seconds. Accordingly, the fourth measured value may be the UBVMA value for the maximum of 5 seconds. In addition, even before reaching the eighth time, when the laundry is dispersed, the re-measured fourth measured value may be equal to or smaller than the fourth reference value, which means that the magnitude of the unbalance is small, so that the control method of the present disclosure may directly stop the rotation of the drum 3 (S6300).

This is because, when the drum 3 rotates at the fifth speed, the fourth measured value is already equal to or smaller than the fourth reference value, and thus, there is no need to maintain the rotation at the fourth speed anymore.

After stopping the rotation of the drum 3, in order to determine the degree of the occurrence of the unbalance, the control method of the present disclosure may repeat the third maintaining operation (S4100), the fourth measurement operation (S4500), the fourth maintaining operation (S5100), the fourth measurement operation (S5500), and the second stop operation (S6300) of stopping the rotation of the drum 3 as much as the second number of repetitions (S6400).

During the repetition, the preset second waiting time may be set between two sets of repetition. That is, the control method of the present disclosure does not proceed to the first maintaining operation (S1100) immediately after stopping the rotation of the drum 3, but starts again from the first maintaining operation (S1100) after waiting for the second waiting time.

When the first number of repetitions is set to 2, when describing only the rotation state of the drum 3, the rotation state of the drum 3 may be changed in an order of the stop, the first-speed rotation, the second-speed rotation, the rotation stop, the second waiting time, the first-speed rotation, the second-speed rotation, and the stop.

In one example, the repetition may be made with the fact that the third maintaining operation (S4100) is maintained for the fifth time (S4300), the third measurement operation is maintained up to the sixth time (S4800), and, when the third measured value is equal to or smaller than the third reference value (S4700) even before reaching the sixth time, the control method of the present disclosure proceeds to the fourth maintaining operation (S5100), as described above.

In addition, the repetition may be made with the fact that the fourth maintaining operation (S5100) is maintained for the seventh time (S5300), the fourth measurement operation (S5500) is maintained up to the eighth time (S5800), and, when the fourth measured value is equal to or smaller than the fourth reference value (S5700) even before reaching the eighth time, the control method of the present disclosure proceeds to the operation (S6300) of stopping the drum 3, as described above.

The second number of repetitions may be preferably set to 3. During the repetition for the second number of repetitions, the number of times the fourth measured value is equal to or smaller than the fourth reference value is counted and referred to as the second number of times. Accordingly, the second number of times means the total number of times the fourth measured value is equal to or smaller than the fourth reference value in the second UB predicting operation (S35) (see FIG. 2).

In addition, during the repetition, the preset second waiting time may be set between two sets of repetition. That is, the control method of the present disclosure may wait for the second waiting time before initiating the third maintaining operation (S4100) again after stopping the drum 3 (S6300).

Thereafter, the control method of the present disclosure initiates a second dehydration operation (S6600) of rotating the drum 3 at the preset sixth speed higher than the third speed.

In the case of the second dehydration operation (S6600), the drum 3 is rotated at the high speed such that the water soaked in the laundry flows out. When the controller drives the drum driver 35 to rotate the drum 3 at the high speed, the laundry rotates while being attached to the inner wall of the drum 3, so that the cloth is dehydrated by the centrifugal force. The rotation speed of the drum 3 in the second dehydration operation (S95) may be set to be equal to or higher than 1000 RPM.

Because the rotation speed of the first dehydration operation (S3600) is smaller than the rotation speed of the second dehydration operation (S6600), the magnitude of the unbalance may be smaller than the unbalance reference value during the dehydration. Therefore, there is no need to control the occurrence of the unbalance in the first dehydration operation (S3600), so that the result of the first UB predicting operation (S35) (see FIG. 2) performed before the first dehydration operation (S3600) may be combined with the result of the second UB predicting operation (S85) (see FIG. 2) and used to predict the magnitude of the unbalance in the second dehydration operation (S6600). The magnitude of the unbalance in the second dehydration operation (S6600) may be predicted more accurately by going through the two UB predicting operations (S35 and S85). In addition, the control method of the present disclosure may predict the degree of the occurrence of the unbalance (or the UB) through the two UB predicting operations (S35 and S85). Accordingly, the control method of the present disclosure may set the unbalance reference value during the dehydration, or apply the appropriate dehydration method based on the expected magnitude of the unbalance.

In other words, the control method of the present disclosure may set the unbalance reference value to be used in the dehydration operation based on the sum of the first number of times and the second number of times. That is, the unbalance reference value to be used in the final dehydration operation (S6600) may be set based on the second measured value and the fourth measured value. For example, when the first number of repetitions is 3 and the second number of repetitions is 3, and when the sum of the first number of times and the second number of times out of a total of 6 repetitions is 0, the cloth may be determined as the cloth with the great amount of UB. In this case, the control method of the present disclosure may loosely set the unbalance reference value to be used in the dehydration operation such that some degree of UB is accepted. Alternatively, the unbalance reference value may be set such that the dispersion of the cloths in the dehydration entry operation that may be added before the final dehydration is performed mor This has an effect of saving time than a case of entering the dehydration entry operation again after decelerating or stopping the rotation of the drum 3 when the unbalance reference value is fixedly used or when the magnitude of the unbalance exceeds the unbalance reference value in the dehydration entry operation because the cloths are not sufficiently dispersed. In addition, there is an effect of reducing the vibration and the noise. One embodiment of the determination method is summarized in Table 1 above.

That is, when the number of dehydrations is 2 and each of the first number of repetitions and the second number of repetitions is set to 3, the total number of repetitions is 6 times. A case in which the sum of the first number of times and the second number of times is 0 is a case in which the second measured value or the fourth measured value is not equal to or smaller than the second reference value or the fourth reference value. Therefore, the cloth may be determined as the cloth with the large amount of UB. In this case, the control method of the present disclosure may loosely set the unbalance reference value to be used in the dehydration operation (S6600) of rotating the drum 3 at the sixth speed preset to be higher than the second speed or the fifth speed such that some degree of UB is accepted. Alternatively, the unbalance reference value may be set such that the dispersion of the cloths in the dehydration entry operation is performed more.

When the sum of the first number of repetitions and the second number of times is equal to or smaller than 3, that is, is 1, 2, or 3, the cloth may be determined as the cloth with the intermediate amount of UB. In addition, when the sum of the first number of repetitions and the second number of times is equal to or greater than 4, that is, is 4, 5, or 6, the cloth may be determined as the cloth with the small amount of UB. In this case, the unbalance reference value to be used in the dehydration operation (S6600) may be strictly set. This is because the time in the dehydration entry operation may be reduced as the cloths are already well dispersed or the moisture content is low. This is merely one embodiment, and another determination method is able to be used when the degree of the occurrence of the UB is able to be predicted.

The present disclosure may be modified and implemented in various forms, so that the scope thereof is not limited to the above-described embodiment. Therefore, when the modified embodiment includes components of the claims of the present disclosure, the modified embodiment should be viewed as belonging to the scope of the present disclosure.

The invention claimed is:

1. A method for controlling a laundry treating apparatus that includes a tub configured to receive water and a drum rotatably disposed in the tub and configured to receive laundry, the method comprising:

rotating the drum to move the laundry in the drum relative to water in the tub;

draining water in the tub to an outside of the tub;

controlling a rotation speed of the drum to a first speed that is preset;

maintaining the first speed of the drum based on the rotation speed of the drum reaching the first speed;

determining a first measured value related to a magnitude of unbalance of the laundry while rotating the drum at the first speed;

based on the first measured value being less than or equal to a first reference value, accelerating the drum to a second speed that is preset;

maintaining the second speed of the drum based on the rotation speed of the drum reaching the second speed;

determining a second measured value related to the magnitude of unbalance of the laundry while rotating the drum at the second speed;

stopping rotation of the drum based on the second measured value being less than or equal to a second reference value;

accelerating the drum to a third speed greater than the second speed to thereby remove water from the laundry;

determining a third measured value related to the magnitude of unbalance of the laundry while accelerating the drum to the third speed; and stopping rotation of the drum based on the third measured value becoming greater than an unbalance reference value while rotating the drum at the third speed, the unbalance reference value being set based on the second measured value.

2. The method of claim 1, wherein the first measured value is determined after maintaining the first speed of the drum for a preset first time.

3. The method of claim 2, wherein the first measured value is determined by an operation performed for a first operation duration, and wherein accelerating the drum to the second speed comprises:

accelerating the drum to the second speed based on (i) the first measured value being greater than the first reference value and (ii) the first operation duration being greater than or equal to a preset second time.

4. The method of claim 3, wherein the second measured value is determined after maintaining the second speed for a preset third time.

5. The method of claim 4, wherein the second measured value is determined by an operation performed for a second operation duration, and wherein stopping rotation of the drum comprises:

stopping rotation of the drum based on (i) the second measured value being greater than the second reference value and (ii) the second operation duration being greater than or equal to a preset fourth time.

6. The method of claim 5, further comprising setting the unbalance reference value by:

repeating a measurement operation for a preset number of repetitions, the measurement operation comprising:

controlling the rotation speed of the drum to the first speed, maintaining the first speed of the drum based on the rotation speed of the drum reaching the first speed, determining the first measured value while rotating the drum at the first speed, based on the first measured value being less than or equal to the first reference value, accelerating the drum to the second speed, maintaining the second speed of the drum based on the rotation speed of the drum reaching the second speed, determining the second measured value while rotating the drum at the second speed, stopping rotation of the drum based on the second measured value being less than or equal to the second reference value; and determining a total number of times at which the second measured value is less than or equal to the second reference value in the preset number of repetitions of the measurement operation; and setting the total number of times as the unbalance reference value.

7. The method of claim 6, further comprising:

suspending one of the measurement operations for a preset waiting time between two of the measurement operations.

8. A method for controlling a laundry treating apparatus that includes a tub configured to receive water and a drum rotatably disposed in the tub and configured to receive laundry, the method comprising:

rotating the drum to move the laundry in the drum relative to water in the tub;

draining water in the tub to an outside of the tub;

controlling a rotation speed of the drum to a first speed that is preset;

maintaining the first speed based on the rotation speed of the drum reaching the first speed;

determining a first measured value related to a magnitude of unbalance of the laundry while rotating the drum at the first speed;

based on the first measured value being less than or equal to a first reference value, accelerating the drum to a second speed that is preset;

maintaining the second speed based on the rotation speed of the drum reaching to the second speed;

determining a second measured value related to the magnitude of unbalance of the laundry while rotating the drum at the second speed;

stopping rotation of the drum based on the second measured value being less than or equal to a second reference value;

accelerating the drum to a third speed greater than the second speed to thereby remove water from the laundry;

supplying water to the tub after rotating the drum at the third speed;

rotating the drum to move the laundry relative to the water supplied to the tub after rotating the drum at the third speed;

draining, to the outside of the tub, the water supplied to the tub after rotating the drum at the third speed;

based on draining the water supplied to the tub after rotating the drum at the third speed, rotating the drum to a fourth speed that is preset;

maintaining the fourth speed based on the rotation speed of the drum reaching the fourth speed;

determining a third measured value related to the magnitude of unbalance of the laundry while rotating the drum at the fourth speed;

based on the third measured value being less than or equal to a third reference value, accelerating the drum to a fifth speed that is preset;

maintaining the fifth speed based on the rotation speed of the drum reaching the fifth speed;

determining a fourth measured value related to the magnitude of unbalance of the laundry while rotating the drum at the fifth speed;

stopping rotation of the drum based on the fourth measured value being less than or equal to a fourth reference value;

accelerating the drum to a sixth speed greater than the third speed to thereby remove water from the laundry;

determining a fifth measured value related to the magnitude of unbalance of the laundry while accelerating the drum to the sixth speed; and stopping rotation of the drum based on the fifth measured value becoming greater than an unbalance reference value while rotating the drum at the sixth speed, the unbalance reference value being set based on the second measured value and the fourth measured value.

9. The method of claim 8, wherein the first measured value is determined after maintaining the first speed of the drum for a preset first time.

10. The method of claim 9, wherein the first measured value is determined by an operation performed for a first operation duration, and wherein accelerating the drum to the second speed comprises:

accelerating the drum to the second speed based on (i) the first measured value being greater than the first reference value and (ii) the first operation duration being greater than or equal to a preset second time.

11. The method of claim 10, wherein the second measured value is determined after maintaining the second speed of the drum for a preset third time.

12. The method of claim 11, wherein the second measured value is determined by an operation performed for a second operation duration, and wherein stopping rotation of the drum based on the second measured value comprises:

stopping rotation of the drum based on (i) the second measured value being greater than the second reference value and (ii) the second operation duration being greater than or equal to a preset fourth time.

13. The method of claim 12, wherein the third measured value is determined after maintaining the fourth speed of the drum for a preset fifth time.

14. The method of claim 13, wherein the third measured value is determined by an operation performed for a third operation duration, and wherein accelerating the drum to the fifth speed comprises:

accelerating the drum to the fifth speed based on (i) the third measured value being greater than the third reference value and (ii) the third operation duration being greater than or equal to a preset sixth time.

15. The method of claim 14, wherein the fourth measured value is measured after maintaining the fifth speed of the drum for a preset seventh time.

16. The method of claim 15, wherein the fourth measured value is determined by an operation performed for a fourth operation duration, and wherein stopping rotation of the drum based on the fifth measured value comprises:

stopping rotation of the drum based on (i) the fourth measured value being greater than the fourth reference value and (ii) the fourth operation duration being greater than or equal to a preset eighth time.

17. The method of claim 8, further comprising setting the unbalance reference value by:

repeating a first measurement operation for a first preset number of repetitions, the first measurement operation comprising:

controlling the rotation speed of the drum to the first speed, maintaining the first speed of the drum based on the rotation speed of the drum reaching the first speed, determining the first measured value while rotating the drum at the first speed, based on the first measured value being less than or equal to the first reference value, accelerating the drum to the second speed, maintaining the second speed of the drum based on the rotation speed of the drum reaching the second speed, determining the second measured value while rotating the drum at the second speed, and stopping rotation of the drum based on the second measured value being less than or equal to the second reference value;

determining a first total number of times at which the second measured value is less than equal to than the second reference value in the first preset number of repetitions of the first measurement operation;

repeating a second measurement operation for a second preset number of repetitions, the second measurement operation comprising:

controlling the rotation speed of the drum to the fourth speed, maintaining the fourth speed based on the rotation speed of the drum reaching the fourth speed, determining the third measured value while rotating the drum at the fourth speed, based on the third measured value being less than or equal to the third reference value, accelerating the drum to the fifth speed, maintaining the fifth speed based on the rotation speed of the drum reaching the fifth speed, determining the fourth measured value while rotating the drum at the fifth speed, and stopping rotation of the drum based on the fourth measured value being less than or equal to the fourth reference value;

determining a second total number of times at which the fourth measured value is less than or equal to the fourth reference value in the second preset number of repetitions of the second measurement operation; and setting a sum of the first total number of times and the second total number of times as the unbalance reference value.

18. The method of claim 17, further comprising:

suspending one of the first measurement operations for a first preset waiting time between two of the first measurement operations; and suspending one of the second measurement operations for a second preset waiting time between two of the second measurement operations.

19. The method of claim 18, wherein the first preset number of repetitions is equal to the second preset number of repetitions.

20. The method of claim 19, wherein the first preset waiting time is equal to the second preset waiting time.

* * * * *